US008774957B2

(12) United States Patent
Maki et al.

(10) Patent No.: US 8,774,957 B2
(45) Date of Patent: Jul. 8, 2014

(54) EMBROIDERY DATA GENERATING DEVICE, COMPUTER READABLE MEDIUM STORING EMBROIDERY DATA PROCESSING PROGRAM, AND SEWING MACHINE

(75) Inventors: Ryutaro Maki, Gifu (JP); Takashi Hirata, Nagoya (JP); Takafumi Naka, Ama (JP); Masashi Tokura, Konan (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 265 days.

(21) Appl. No.: 13/361,401

(22) Filed: Jan. 30, 2012

(65) Prior Publication Data

US 2012/0197430 A1 Aug. 2, 2012

(30) Foreign Application Priority Data

Jan. 31, 2011 (JP) ..... 2011-018070

(51) Int. Cl.
*D05C 5/02* (2006.01)

(52) U.S. Cl.
USPC ..... 700/138; 112/470.01

(58) Field of Classification Search
USPC ..... 700/136–138; 112/470.01, 470.04, 112/470.06, 475.18, 475.19
See application file for complete search history.

(56) References Cited

U.S. PATENT DOCUMENTS 4,869,188 A * 9/1989 Hyodo ..... 112/470.04
5,740,057 A * 4/1998 Futamura ..... 700/138
5,751,583 A 5/1998 Kyuno et al.
5,954,004 A * 9/1999 Futamura ..... 112/475.19
6,012,402 A 1/2000 Sekine
6,304,793 B1 10/2001 Komiya et al.
6,321,670 B1 * 11/2001 Tomita et al. ..... 112/475.19
6,324,441 B1 11/2001 Yamada
RE38,718 E * 3/2005 Futamura ..... 700/138
6,980,877 B1 * 12/2005 Hagino et al. ..... 700/138
7,503,271 B2 3/2009 Hayakawa
7,542,822 B2 6/2009 Kawaguchi et al.
2007/0199492 A1 * 8/2007 Ishii ..... 112/303

FOREIGN PATENT DOCUMENTS

JP A-11-057262 3/1999
JP B2-2874674 3/1999

OTHER PUBLICATIONS

U.S. Appl. No. 13/561,573, filed Jul. 30, 2012 in the name of Yuki Ihira.
U.S. Appl. No. 13/569,759, filed Aug. 8, 2012.
"Overview of Electric Quilt 6 Software," http://www.electricquilt.com/Shop/EQ6/EQ6.asp, Retrieved on Oct. 18, 2010, 6 pages, The Electric Quilt Company.

(Continued)

*Primary Examiner* — Nathan Durham
(74) *Attorney, Agent, or Firm* — Oliff PLC

(57) ABSTRACT

An embroidery data generating device is disclosed. The embroidery data generating device generates embroidery data that is used for sewing an embroidery pattern including multiple color-wise pattern sections with a sewing machine and that includes thread color data specifying a color of each of the color-wise pattern sections. The embroidery data generating device includes a first storage device that stores multiple entries of preset color information; an extractor that randomly extracts color data used as the thread color data from each entry of the color information stored in the first storage device; and an allocator that randomly allocates the color data extracted by the extractor to each of the thread color data associated with each of the color-wise pattern sections.

20 Claims, 17 Drawing Sheets

(56) References Cited

OTHER PUBLICATIONS

"User's Guide to Electric Quilt 6 Software," http://www.rasenkaidan.com, Retrieved on Oct. 18, 2010, 13 pages, Rasenkaidan.

"User's Guide to Adobe Illustrator CS4," http://help.adobe.com/en_US/Illustrator/14.0/WS8F5038A7-E2BE-402f-B15F-850702A681C2a.html, Retrieved on Apr. 2, 2012, 8 pages (with translation).

Jan. 17, 2014 Notice of Allowance issued in U.S. Appl. No. 13/569,759.

Jan. 17, 2014 Office Action issued in U.S. Appl. No. 13/561,573.

* cited by examiner

| EMBROIDERY DATA | |
|---|---|
| FIRST PATTERN SECTION DATA | PATTERN 1 PURPLE |
| | Xa0,Ya0 |
| | Xa1,Ya1 |
| | Xa2,Ya2 |
| | ⋮ |
| | XaN,YaN |
| SECOND PATTERN SECTION DATA | PATTERN 2 ROSE |
| | Xb0,Yb0 |
| | Xb1,Yb1 |
| | Xb2,Yb2 |
| | ⋮ |
| | XbN,YbN |
| THIRD PATTERN SECTION DATA | PATTERN 3 MAGENTA |
| | Xc0,Yc0 |
| | Xc1,Yc1 |
| | Xc2,Yc2 |
| | ⋮ |
| | XcN,YcN |
| ⋮ | ⋮ |
| nTH PATTERN SECTION DATA | PATTERN n MAGENTA |
| | Xn0,Yn0 |
| | Xn1,Yn1 |
| | Xn2,Yn2 |
| | ⋮ |
| | XnN,YnN |

FIG. 4

EMBROIDERY DATA GENERATING DEVICE, COMPUTER READABLE MEDIUM STORING EMBROIDERY DATA PROCESSING PROGRAM, AND SEWING MACHINE

CROSS-REFERENCE TO RELATED APPLICATION

This application is based upon and claims the benefit of priority from the prior Japanese Patent Application 2011-018070, filed on, Jan. 31, 2011, the entire contents of which are incorporated herein by reference.

FIELD

The present disclosure relates to an embroidery data generating device that generates embroidery data used for sewing embroidery patterns configured by multiple color-wise pattern sections with a sewing machine. The present disclosure also relates to a computer readable medium and a sewing machine.

BACKGROUND

Sewing machines have been available that sew embroidery patterns based on embroidery data. Such sewing machines store data of embroidery patterns in its internal storage or external storage such as ROM cards and flexible disks. The user is allowed to choose the desired pattern from the selection of such embroidery patterns. The sewing machine reads the embroidery data of the selected embroidery pattern and forms embroidery patterns on the workpiece by transferring the embroidery frame holding the workpiece by way of the transfer mechanism.

The embroidery data of embroidery patterns configured by multiple patterns contains thread color data which is associated with a color-wise pattern section and thus, the color-wise pattern section is sewn in the color of the preset thread color. When a color of a given color-wise pattern section is similar to the color of the workpiece, it may be difficult to distinguish the color-wise pattern section from the workpiece. Taking the example of an embroidery pattern of a "flower" in which the color-wise pattern corresponding to the petals of the flower are identical or similar in color as the workpiece, it may be difficult to distinguish the petals from the workpiece. Thus, the finished pattern may unwantedly appear as a strange embroidery pattern without any pedals.

To address such concerns, embroidery data generating devices have been proposed which pre-store coloring data containing preferable combinations of color. The embroidery data generating device is configured to specify the color of the thread color data associated with the color-wise patterns section based on such coloring data and workpiece data containing information such as the color of the workpiece.

According to such embroidery data generating device, coloring data that defines preferable combinations of colors is pie-stored and the color of the color-wise pattern section of the embroidery pattern is primarily determined based on the workpiece color and the coloring data. However, the user may not want the color of the color-wise pattern section to be confined by the workpiece color or a predetermined color but rather sew the pattern by specifying a preferred color or in an unusual coloring. However, allowing such user specification requires every data entry of the color-wise patterns to be parsed to determine the availability of the specified color and thus, is cumbersome.

SUMMARY

One object of the present disclosure is to provide an embroidery data generating device which generates embroidery data that is used for sewing an embroidery pattern including multiple color-wise pattern sections with a sewing machine and that includes thread color data specifying a color of each of the color-wise pattern sections. The embroidery data generating device includes a first storage device that stores multiple entries of preset color information; an extractor that randomly extracts color data used as the thread color data from each entry of the color information stored in the first storage device; and an allocator that randomly allocates the color data extracted by the extractor to each of the thread color data associated with each of the color-wise pattern sections.

Other objects, features and advantages of the present disclosure will become clear upon reviewing the following description of the illustrative aspects with reference to the accompanying drawings.

BRIEF DESCRIPTION OF THE DRAWINGS

FIG. 4 is an exemplary configuration of embroidery data;

DETAILED DESCRIPTION

One embodiment of the present invention is exemplified through a household sewing machine hereinafter referred to as sewing machine M and will be described in detail with reference to FIGS. 1 to 16.

Figure 1:
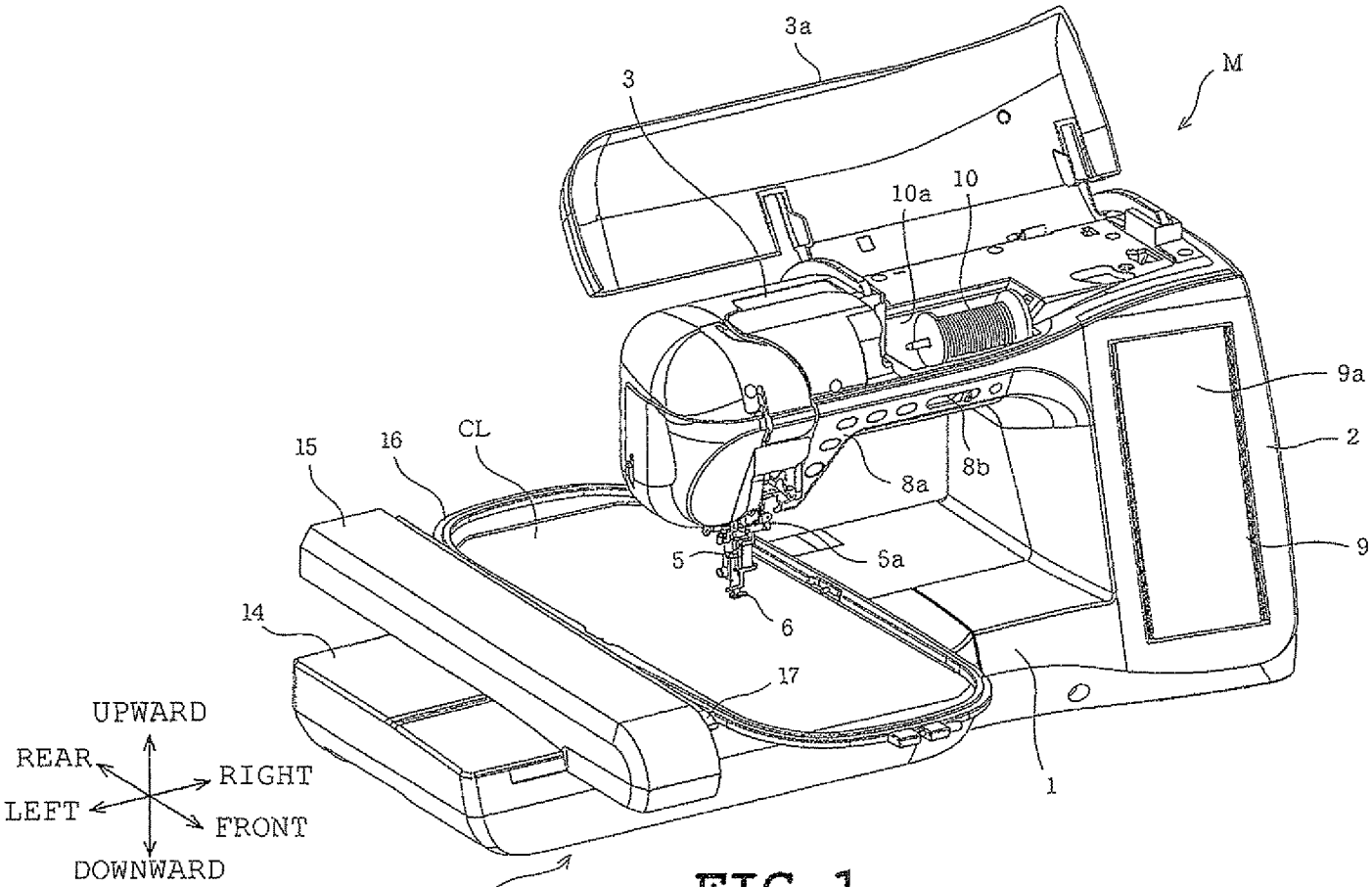
FIG. 1 is a general perspective view of a sewing machine.

Referring to FIG. 1, sewing machine M is primarily configured by bed 1, pillar 2, and arm 3 that are structurally integral. Pillar 2 extends upward from the right end of a laterally oriented bed 1. Arm 3 extends leftward from the upper portion of pillar 2 and contains a laterally extending main shaft not shown of the sewing machine and sewing machine motor 4 shown in FIG. 2 that drives the main shaft in rotation. Description will be given hereinafter with an assumption that the direction in which the user/operator positions himself/herself to face sewing machine M is the forward direction and the opposite side, naturally, is the rear direction. Further, the direction in which pillar 2 is located relative to the center of bed 1 is assumed as the rightward direction and the opposite side, is assumed as the left direction.

At one end of arm 3 distal from pillar 2, needle bar 5*a* and presser bar not shown are provided. Needle bar 5*a* has sewing needle 5 attached to it whereas the presser bar has a presser foot 6 attached to it. Though not shown, arm 3 further contains components such as a needle-bar drive mechanism, a needle-bar swing mechanism, a thread take-up drive mechanism, and a presser-bar drive mechanism. The needle-bar drive mechanism moves needle bar 5*a* up and down through the rotation of the main shaft. The needle-bar swing mechanism swings needle bar 5*a* in a direction orthogonal to the direction in which the workpiece is fed. In the present embodiment, needle bar 5*a* is swung in the left and right direction. The thread take-up drive mechanism drives the thread-take up and down in synchronism with the up and down movement of needle bar 5*a*. The presser-bar drive mechanism drives the presser bar up and down.

At the upper portion of arm 3, openable/closable cover 3*a* is provided that, when opened, reveals slot 10*a* defined on the forward mid portion of arm 3 for storing thread spool 10. Needle thread drawn from thread spool 10 is engaged with a number of components such as the thread take-up that define a thread passageway to be ultimately supplied to sewing needle 5.

On the front side of arm 3, various operation switches such as start/stop switch 8*a* for starting and stopping a sewing operation is provided as well as speed adjustment dial 8*b* for setting the sewing speed, in other words, the speed of rotation of the main shaft.

On the front face of pillar 2, a sizable and vertically elongate liquid crystal display 9 capable of displaying in full color is provided, which is hereinafter simply referred to as LCD 9. LCD 9 displays various information such selection of patterns including embroidery patterns and utility stitches, names of various functionalities to be executed in a sewing operation, and user interfaces such as screens such as those shown in FIG. 5 for setting the colors to be applied to the embroidery pattern as later described. On the front face of LCD 9, touch panel 9*a* is provided as shown in FIG. 2 that has multiple touch keys comprising transparent electrodes and touch keys 9*a* are depressed by the user's fingers or a touch pen not shown for selecting embroidery patterns to be sewn, giving instructions for executing the desired function and setting various parameters, etc.

Figure 2:
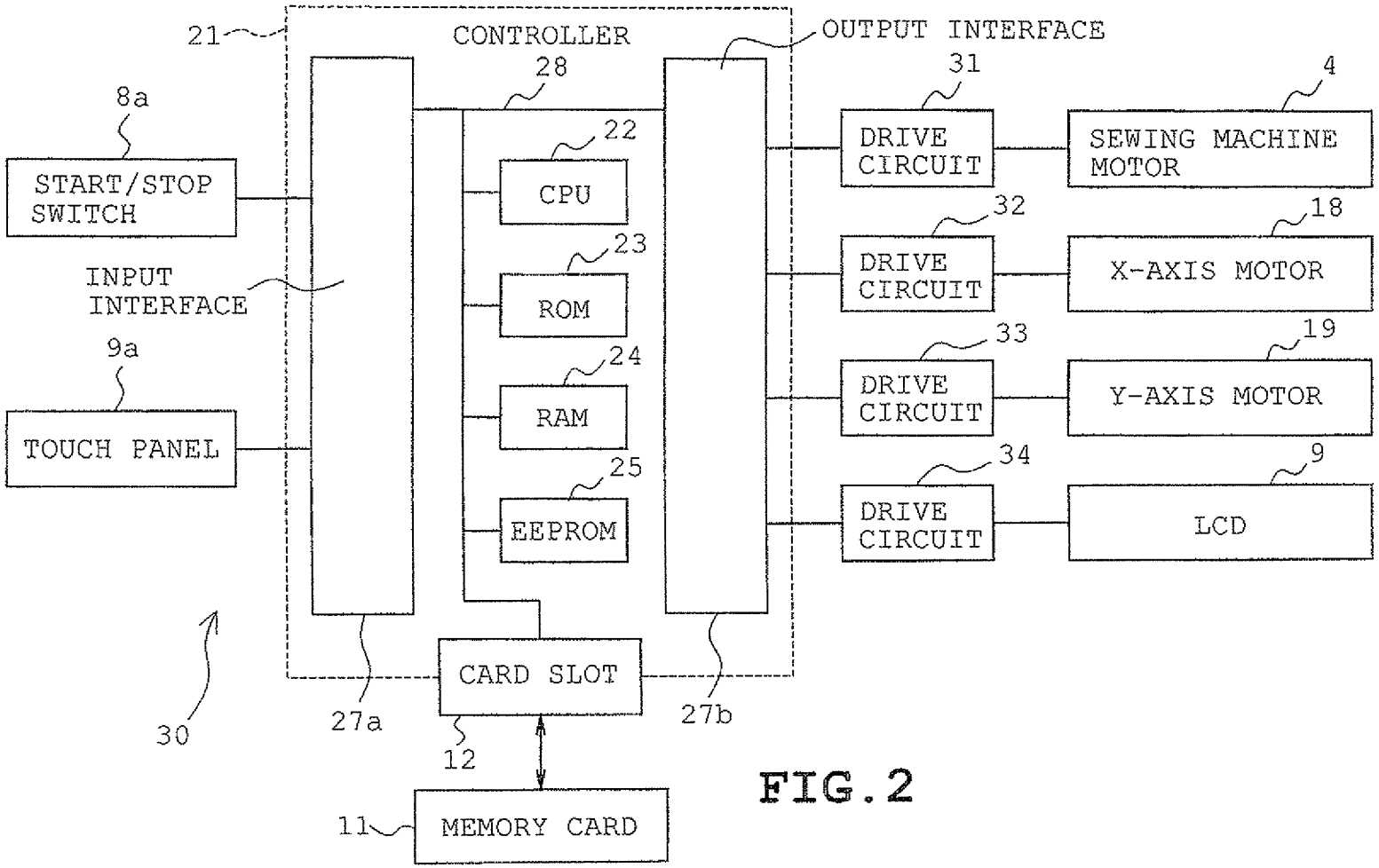
FIG. 2 is a block diagram indicating an electrical configuration of the sewing machine.

On the right side surface of pillar 2, card slot 12 is provided for insertion of memory card 11 only shown in FIG. 2 that stores data such as embroidery data for various types of embroidery patterns.

On the upper surface of bed 1, a needle plate not shown is provided. Within bed 1 below the needle plate are components such as a cloth feed mechanism, a horizontal shuttle mechanism, and a thread cutter are provided neither of which are shown. The cloth feed mechanism drives a feed dog up and down and back and forth. The horizontal shuttle mechanism contains a bobbin thread bobbin and forms stitches in cooperation with sewing needle 5. The thread cutter mechanism cuts needle thread and bobbin thread.

Bed 1 allows detachable attachment of embroidery frame transfer device 13 at its left end. Embroidery frame transfer device 13 is primarily configured by body 14 and movable section 15. Body 14 is substantially level with the upper surface of bed 1 when embroidery frame transfer device 13 is attached to bed 1. Movable member 15 is provided on the upper surface of body 14 so as to be movable in the left and right direction over body 14. Embroidery frame transfer device 13 is further provided with carriage 17, an X-direction transfer mechanism and Y-direction transfer mechanisms that are neither shown. Carriage 17 is attached to movable member 15 so as to be movable in the front and rear direction relative to movable member 15 and allows detachable attachment of embroidery frame 16 which holds workpiece CL to be sewn. The X-direction transfer mechanism drives the carriage 17 as well as movable member 15 in the left and right direction. Y-direction transfer mechanism drives carriage 17 in the front and rear direction. The X- and Y-direction transfer mechanisms are each provided with a dedicated motor later described, namely X-axis motor 18 and Y-axis motor 19 shown in FIG. 2, to drive carriage 17 holding embroidery frame 16 in the X and Y directions respectively.

Next, a description will be given on the electrical configuration of sewing machine M with reference to the block diagram of FIG. 2.

Controller 21 is primarily configured by a microcomputer including CPU 22, ROM 23, RAM 24, card slot 12, input interface 27*a*, output interface 27*b*, and bus 28 interconnecting the foregoing elements. Input interface 27*a* establishes connection with components such as start/stop switch 8*a* and touch panel 9*a*, whereas output interface 27*b* establishes connection with components such as sewing machine motor 4, X-axis motor 18, Y-axis motor 19, display 9 and drive circuits 31, 32, 33, and 34 that drive the foregoing components. Controller 21, display 9, and drive circuit 34 are examples of a display unit. Components such as controller 21, touch panel 9*a*, display 9, and drive circuit 34 constitutes embroidery data generating device 30.

ROM 23 pre-stores items such as embroidery data, a sew control program, a master thread information table, and a display control program that controls LCD 9. The master thread information table contains all the information pertaining to types of threads used in embroidering such as a later described color information, and product ID. ROM 23 further stores embroidery data processing program that contains processes for generating embroidery data. The foregoing programs and data may be stored in internal storage devices such as EEPROM 25 or external storage devices such as memory card 11. In case the embroidery data processing program is stored in the external storage device, controller 21 executes the program by reading it into RAM 24.

Figure 3:
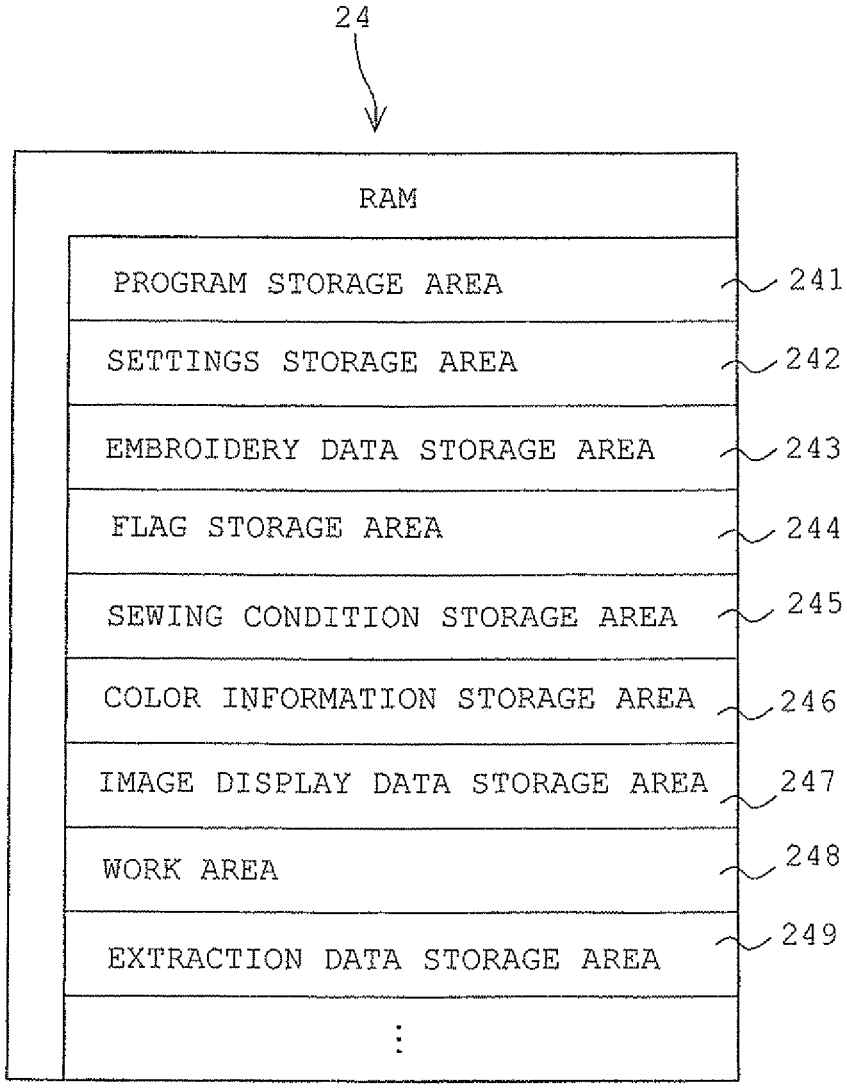
FIG. 3 is a schematic representation of storage areas within RAM of the sewing machine.

RAM 24 is provided with storage area for temporarily storing data such as the above described programs, data, various settings made through touch panel 9*a*, and the result of calculation by controller 21. RAM 24 is one example of a first storage device. FIG. 3 exemplifies RAM 24 provided storage areas such as program storage area 241, settings storage area 242, embroidery data storage area 243, flag storage area 244, sewing condition storage area 245, color information storage area 246, image display data storage area 247, work area 248, and extraction data storage area 249. Program storage area 241 stores various programs read from sources such as ROM 23. Settings storage 242 stores settings and look-up tables being referred on program execution. Embroidery data storage area 243 stores the source data on which the embroidery data generation is based. Flag storage area 244 stores various flags used on program execution. Sewing condition storage area 245 stores various conditions applied when sewing a given embroidery pattern.

Color information storage area 246 is an area for storing data used in coloring the embroidery patterns and stores information such as the later described palette table and palette-wise color numbers. Extraction data storage area temporarily stores colors randomly extracted from the palette table. Image display data storage area 247 stores image data of screens to be displayed on LCD 9 and the settings to be applied to the content being displayed. Work area 248 is an extra area reserved for storing settings or parameters applied during execution of various programs.

Next, an embroidery pattern in the context of the present invention will be described through an example of embroidery pattern 40 displayed on screen 104 of LCD 9 which is an illustration of a flower. Embroidery pattern 40 comprises an n number of color-wise pattern sections identified as first pattern section 401 to nth pattern section 40*n*. More specifically, first patter section 401 that represent the petals of the flower are sewn in purple, second pattern section 402 that represent the leaves are sewn in rose, third pattern section 403 that represent the stems are sewn in magenta. As described above, pattern sections 401 to 40*n* are color-wise patterns that are each designated with a color. Colors set to each of pattern sections 901 to 40*n* need not be unique.

Embroidery data is used to sew embroidery pattern with sewing machine M and comprises multiplicity of color-wise pattern section data. Referring FIG. 4, for instance, the embroidery data of embroidery pattern 40 contains multiplicity of needle drop data specified for each of pattern sections 401 to 40*n*, sewing sequence data specifying the sequence in which pattern sections 401 to 40*n* are formed as indicated as "PATTERN 1, . . . , PATTERN N", and thread color data. Thread color data is data appended to assign a color to each color-wise pattern section and the color is assigned from the collection of color information.

Still referring to FIG. 4, "PATTERN 1" appearing in the top row of the first pattern section indicates the sewing sequence data that identifies the first sewn pattern section and "PURPLE" is the color data indicating the color in which the pattern section is to be sewn which is specified by color models such as RGB values in implementation. Needle drop data "Xa0, Ya0" . . . "XaN, YaN" indicate the coordinates in which the sewing needle carrying the purple thread color is to be struck in the given sequence. Pattern section data sewn second in sequence and onwards similarly contain sewing sequence data which range, in this case, from "PATTERN 2" to "PATTERN n"; thread color data ranging from "ROSE" to "magenta"; and needle drop data ranging from "XbN, YbN" to "XnN, YnN". Embroidery data also contains image data such as bmp data not shown that are to be displayed on LCD 9, and the image of the embroidery pattern appears on LCD 9 in the color assigned by the thread color data.

EEPROM 25 stores color information from which the thread color is assigned as thread color data. The color information pertains to the colors of threads wound on thread spools 10 which are available to sewing machine M and is preset in RGB values. In the present embodiment, some of the color information stored in EEPROM 25 is implemented as a first palette table which contains information for producing first color palette 53 shown in FIG. 6. The first palette table contains RGB values of 64 colors and palette-wise color numbers 1 to 64 associated with each RGB value. Apart from the first palette table, EEPROM 25 further implements some of the color information as a second palette table which stores information of colors pre-selected by the user from the color information. The second palette table contains information for producing second color palette 56*a* shown in FIG. 7. The second palette table may be edited by the user to contain RGB values and the associated palette-wise color numbers for a maximum of 300 colors.

The present invention further employs HSV color model which is a different representation of ROB values. HSV stands for Hue, Saturation, and Value and HSV value is calculated by controller 21 based on RGB values by applying known calculation methods. Color phase value H indicates the types of color such as red, purple, and blue, and is represented by a numerical range of 0 to 360. Saturation value S indicates the vividness of the color and is represented by a numerical range of 0.0 to 1.0. Brightness value V indicates the brightness of the color and is represented by a numerical range of 0.0 to 1.0.

Figure 8:
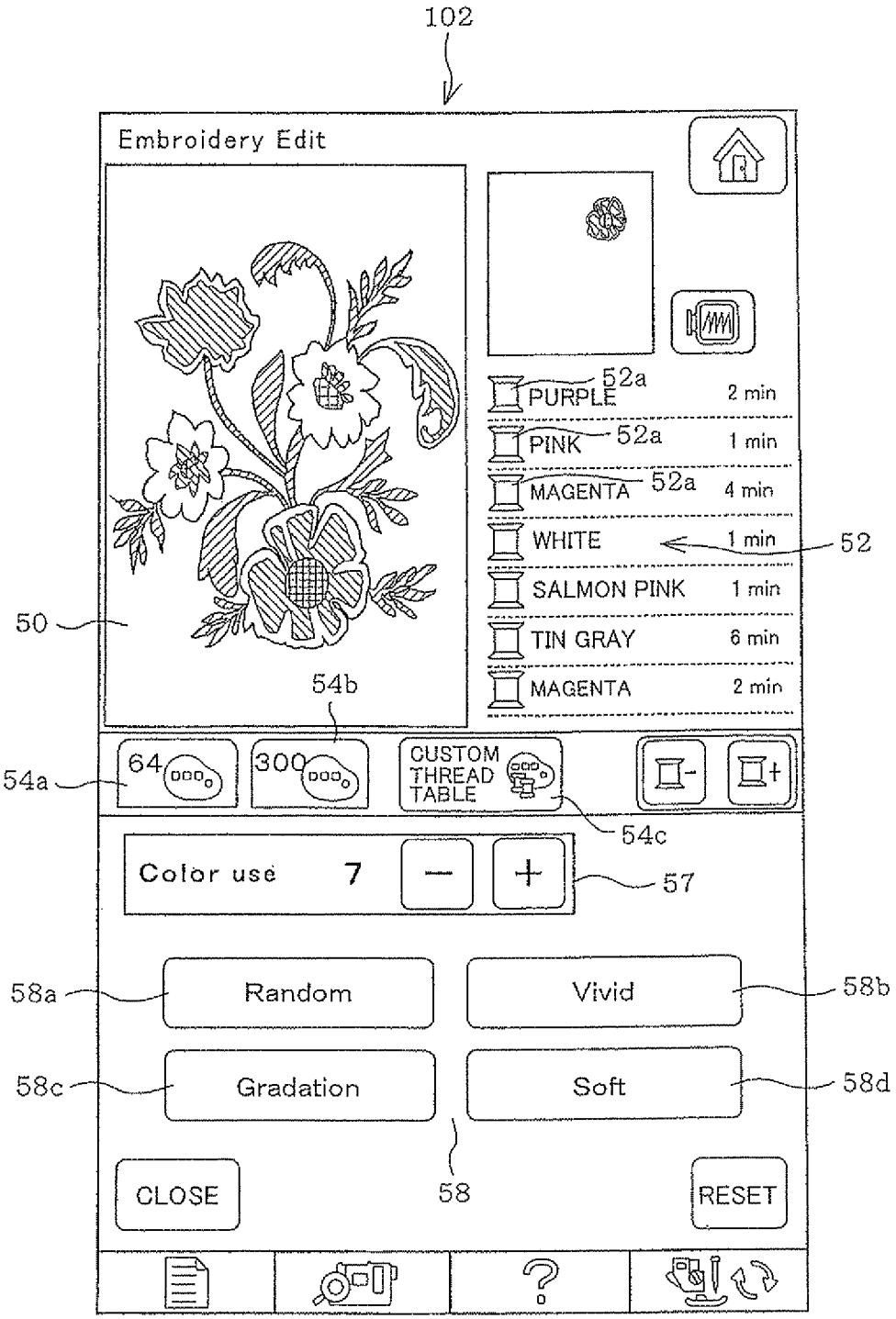
FIG. 8 is an exemplary image of a tone setting screen.

The color information may be categorized by type such as "Vivid", "Soft", and "Gradation" as shown in FIG. 8. Each category of the color information is distinguished by threshold values represented by HSV values.

Figure 13A:
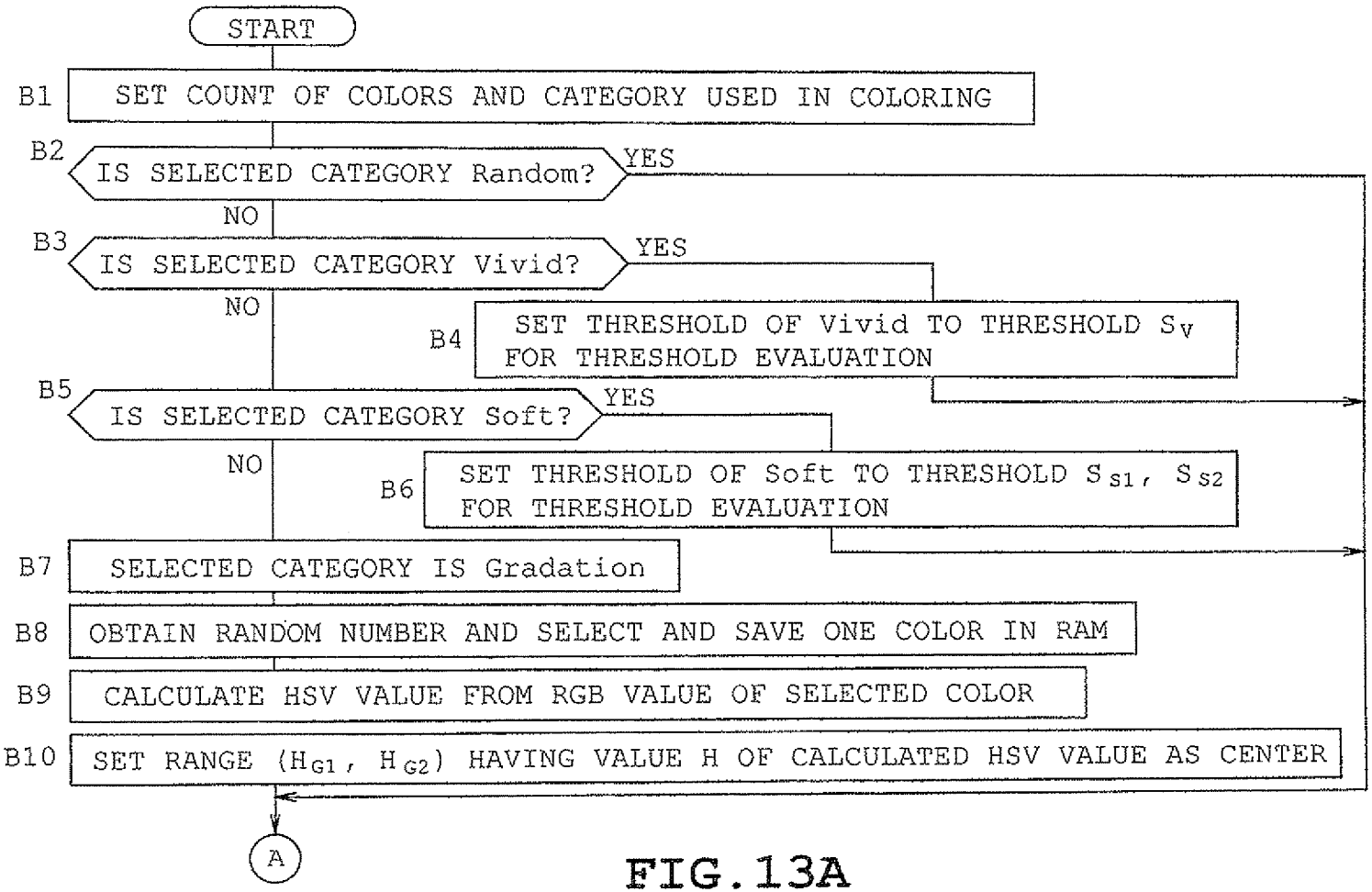
FIGS. 13A and 13B taken together indicate a flowchart of a category-based extraction process.

For instance, the "Vivid" category is established by setting threshold $S_V$ for saturation value S as indicated in step B4 of FIG. 13A. The "Vivid" category contains the color information having saturation value S greater than threshold $S_V$. The colors categorized as "Vivid" have a vivid tone and has a relatively high level of saturation. The "Soft" category is established by setting a range of saturation value S defined by upper limit $S_{S1}$ and lower limit $S_{S2}$ as indicated in step B6 of FIG. 13A. The colors categorized as "Soft" do not vary significantly in the level of saturation and generally give a soft impression. The "Gradation category" established by setting a range of color phase defined by a color phase level centering on a certain color such as purple and spanning between thresholds $H_{G1}$ to $H_{G2}$ as indicated in step B10 of FIG. 13A. The colors categorized as "Gradation" thus, show a gradation of a given color such as purple ranging between threshold $H_{G1}$ which may correspond to red and threshold $H_2$ which may correspond to blue. Each of the above described thresholds $S_V$, $S_{S1}$, $S_{S2}$, $H_{G1}$ and $H_{G2}$ are stored in EEPROM 25.

Controller 21 generates a random number using a program function taking the maximum color-wise palette number as a parameter. Stated differently, controller 21 generates a random number ranging, for instance, between 1 to 64, which is the possible range taken by the palette-wise color number in the present embodiment. Controller 21 searches the palate-wise color number ranging between 1 to 64 within the first palette table that matches with the generated random number and extracts information such as the RGB value associated with the matching palette-wise color number. Thus, a color is randomly selected from 64 cells of first color palette 53, each cell representing 1 of the 64 colors. In case one of the above described categories is selected, a random number is generated from the range of numbers belonging to the selected category and the generated random number is used to randomly extract a color from the selected category.

Figure 5:
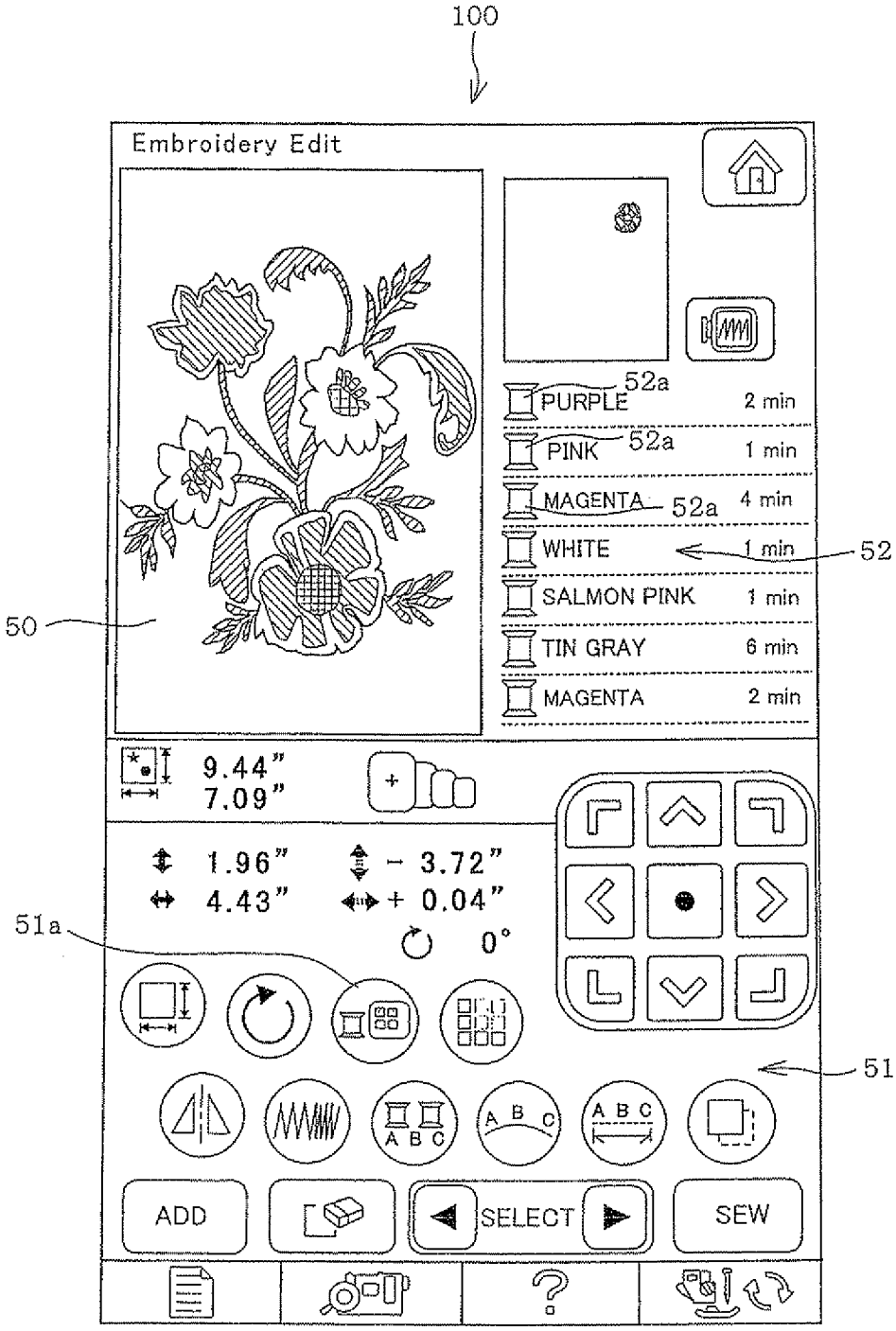
FIG. 5 is an exemplary image of a menu screen displayed during the generation of the embroidery data.
Figure 9:
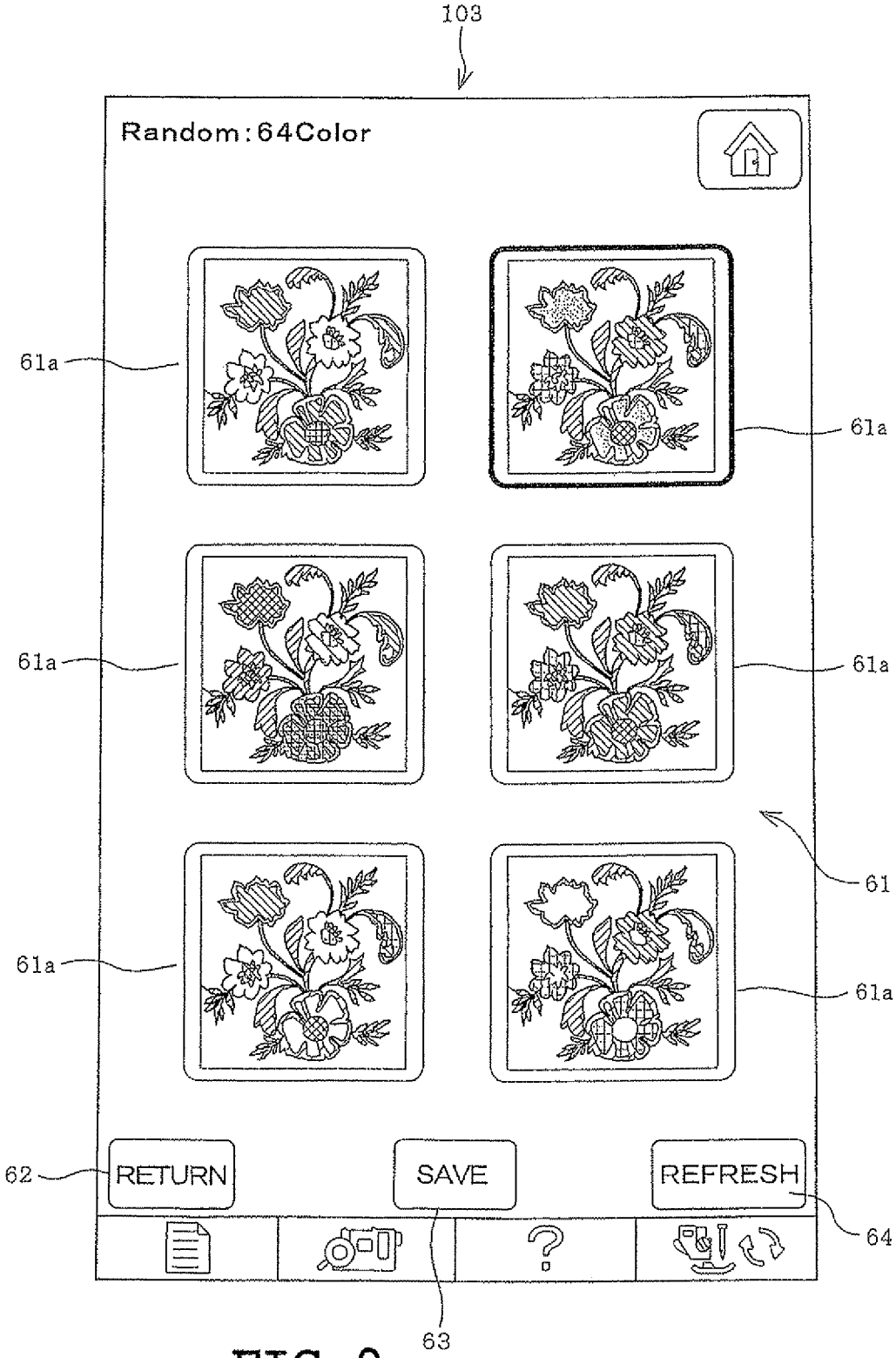
FIG. 9 is an exemplary image of a thumbnail screen.
Figure 10:
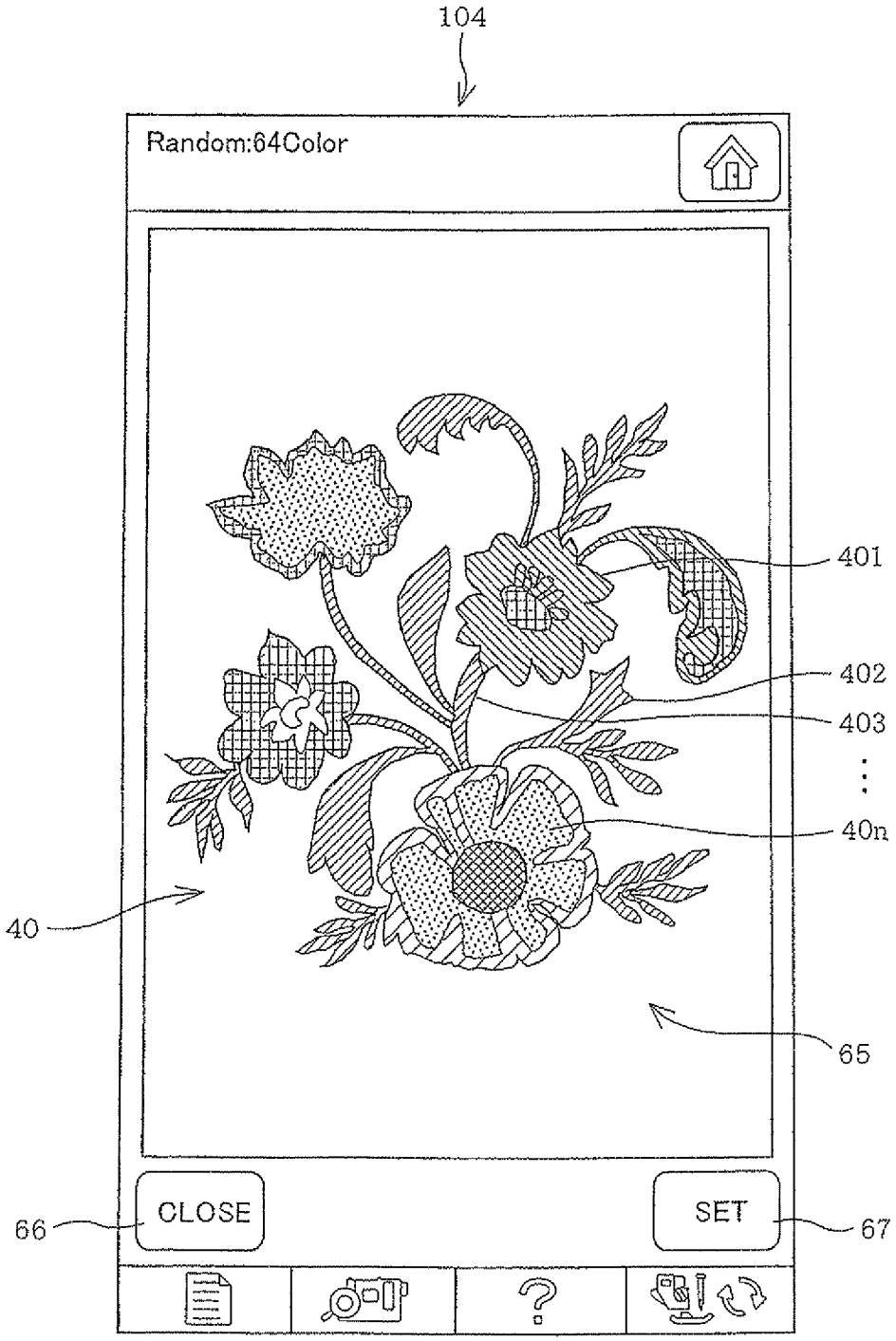
FIG. 10 is an exemplary image of an enlarge screen.

Next, a description will be given on the screens displayed on LCD 9 during the generation of embroidery data and particularly during the coloring of the thread color with reference to FIGS. 5 and 11C. FIGS. 5 to 11C illustrate screens 100 to 104 displayed on LCD 9. Because LCD 9 is a color display, contents of screens 100 to 104 such as embroidery pattern images and first and second color palettes 53 and 56*a* can be displayed in various range of colors.

FIG. 5 exemplifies menu screen 100 displayed prior to the coloring in the embroidery data generation. Menu screen 100 comprises preview image area 50 that displays a preview image, thread data selection area 52, and input keys 51 including thread color edit key 51*a*. A preview image is an image of the end result of an embroidery operation performed based on the embroidery data corresponding to the embroidery pattern selected by the user. Depression or the operation of thread color edit key 51*a* implemented as the aforementioned touch key invokes first color edit screen 101A shown in FIG. 6.

First color edit screen 101A comprises first color palette 53, palette selection keys 54*a*, 54*b*, 54*c*, and shuffle key 55 in addition to preview image area 50 and thread color data selection area 52. First color edit screen 101A allows various settings to be made on thread color. For example, thread color selection area 52 provides a list of colors along with icons of thread spool 52*a* in the listed color that are associated with each of the color-wise pattern section of the embroidery pattern displayed in preview mage area 50. The user is allowed to edit the color for each color-wise pattern section by selecting from the choice of colors shown in first color palette 53. First color palette 53 contains 64 cells of colors arranged in 8 rows with each row containing 8 cells. Each of the 8 cells in the topmost row is assigned an RGB value of palette-wise color number 1 to 8 defined in the first palette table starting from the leftmost cell. The rest of the rows are numbered in the similar manner up to number 64. Thus, first color palette 53 contains 64 colors representing the color information contained in the first color table.

Figure 7:
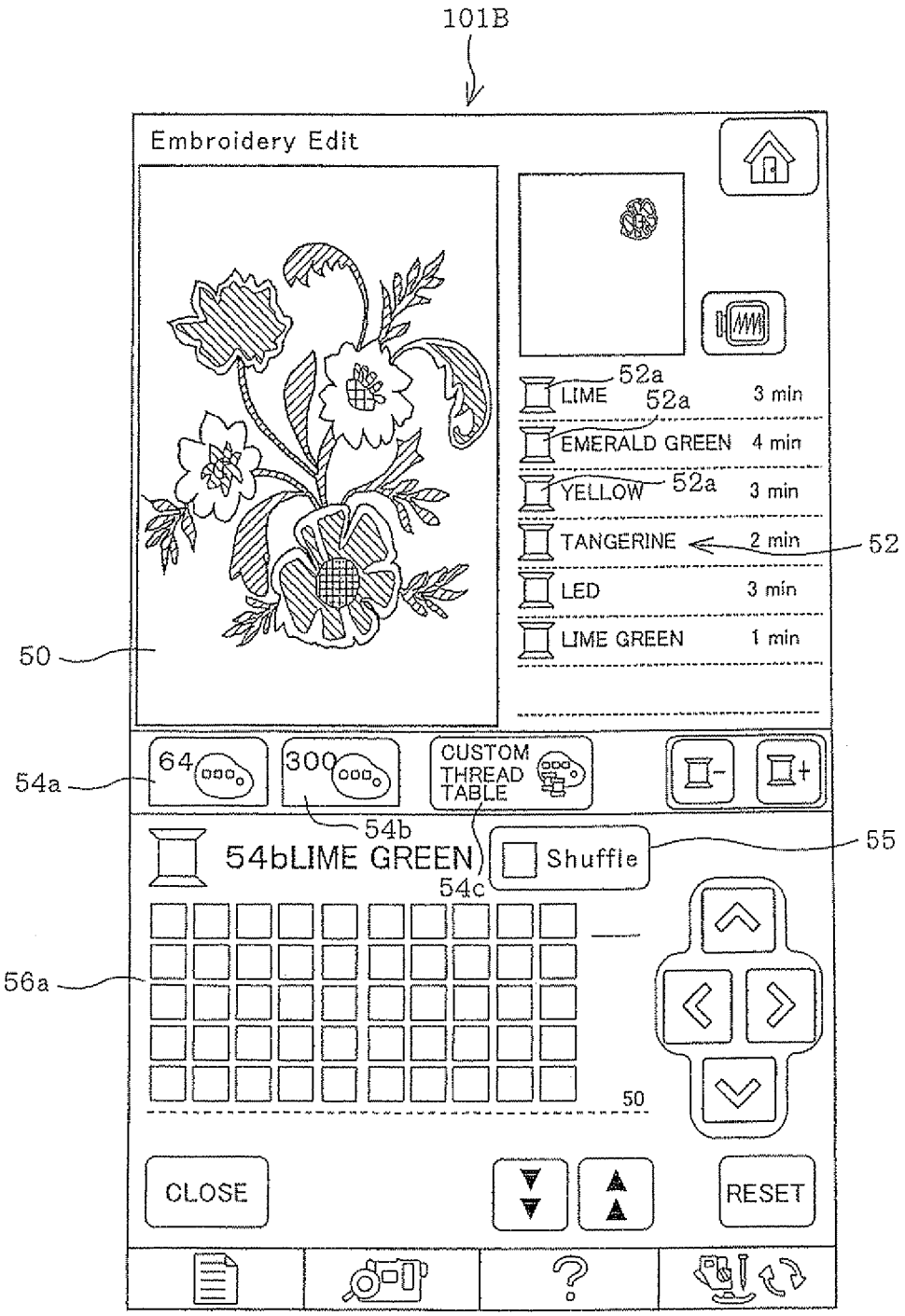
FIG. 7 is an exemplary image of a second color edit screen.

Referring now to FIG. 7, second color edit screen 101B comprises preview image area 50 just like first color edit screen 101A and is provided with second color palette 56*a* instead of first color palette 53. Second color palette 56*a* represents the second palette table and is capable of accommodating a maximum of 300 colors into 300 cells each associated with the RGB values of the color information. FIG. 7 partially shows 50 out of the 300 cells of second color palette 56*a*. First and second color edit screen are switched interchangeably by operating the pair of palette selection keys 54*a* and 54*b*. By operating shuffle key 55, tone setting screen 102 is invoked.

Tone setting screen 102 is provided with preview image area 50, etc. just like first color edit setting screen 101A and is further provided with color count specifier 57, category specifier 58, and random key 58*a*. The total number of colors to be used as the thread color data of the embroidery data can be specified by operating the plus or the minus keys of color count specifier 57. For instance, when only 7 colors are specified by color count specifier 57, the embroidery pattern is colored with only 7 colors. Category specifier 58 is provided with keys 58*b*, 58*c*, and 58*d* associated with "Vivid", "Soft", and "Gradation" categories respectively. Random key 58*a* randomly extracts a color for each thread color data from the either of the palette tables and randomly assigns the extracted colors to the pattern sections. Further, by operating either of "Vivid", "Soft", and "Gradation" keys, a color is randomly selected from the selected category to be used as thread color data. Then, thumbnail screen 103 shown in FIG. 9 is displayed.

Thumbnail screen 103 comprises embroidery pattern selection area 61 which displays multiple embroidery patterns, such as 6 in number, return key 62, save key 63, and refresh key 64. Embroidery pattern selection area 61 displays shrunk thumbnail images 61*a* of embroidery patterns which were produced by uniquely combining the colors randomly extracted as the thread color data. As later described, when save key 63 and thumbnail image 61*a* are touched in the listed sequence, the embroidery pattern associated with the touched thumbnail image 61*a* is saved to EEPROM 25, which is one example of a second storage device. Operation of refresh key 64 reassigns newly extracted colors to the thread color data and the six currently displayed embroidery patterns are replaced with six new embroidery patterns. Operation of return key 62 returns the process flow back to tone setting screen 102. Further, touching thumbnail image 61*a* in thumbnail screen 103 invokes enlarge screen 104 shown in FIG. 10.

Enlarge screen 104 comprises enlarged image area 65, close key 66, and set key 67. In the present embodiment, enlarge screen 104 displays an enlarged image of an embroidery pattern corresponding to the selected thumbnail image 61*a* in FIG. 9 which is highlighted in bold frame. Operation of close key 66 closes enlarge screen 104 and focus is returned to thumbnail screen 103. Touching set key 67 returns the process back to menu screen 100 and populates the embroidery pattern displayed in enlarged image area 65 into the preview image screen of menu screen 100.

Figure 11A:
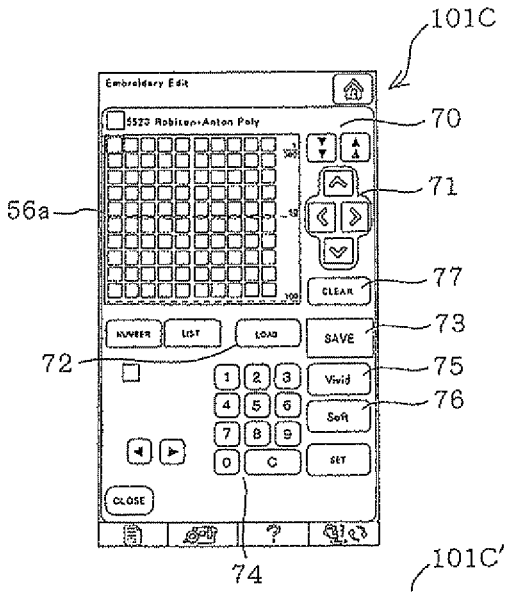
FIG. 11A is an exemplary image of a palette setting screen with an empty palette.

Referring back to first or second color edit screen 101A or 101B, depression of palette selection key 54*c* invokes palette setting screen 101C shown in FIG. 11A. Palette setting screen 101C comprises a second color palette 56*a*, scroll key 70, four navigation keys 71, load key 72, save key 73, numerical keys 74, "Vivid" extraction key 75, Soft extraction key 76, and clear key 77. Second color palette 56*a* shown in FIG. 11A is, yet to be specified with colors and a hundred of the three-hundred cells are displayed. The remaining two-hundred cells can be shown by operating scroll key 70.

Figure 11B:
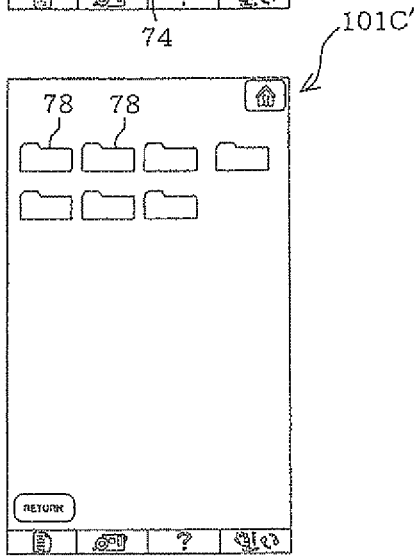
FIG. 11B is an exemplary image of a palette selection screen.
Figure 11C:
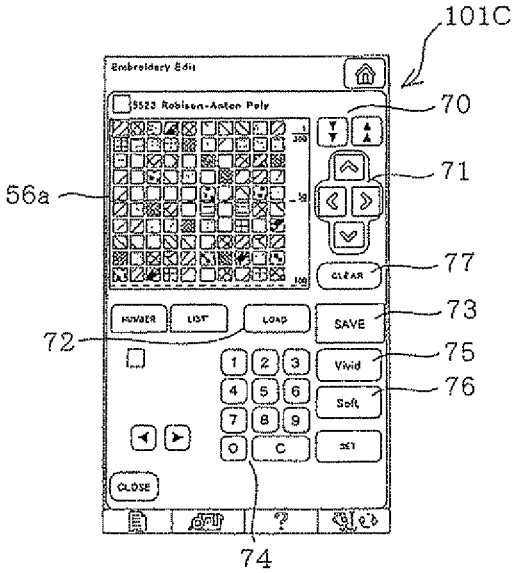
FIG. 11C is an exemplary image of the palette setting screen with the palette loaded with colors.

Operation of load key 72 invokes palette selection screen 101C' which displays multiple files 78 as can be seen in FIG. 11B. By operating the desired file 78 from the multiple files 78 shown in palette selection screen 101C' second palette table is read from the selected file 78 to load the second palette table into second color palette 56*a* as can be seen in FIG. 11C. Alternatively, a color may be inputted one by one to each cell through navigation keys 71. For instance, through navigation keys 71, focus may be placed on the cell located in the upper left corner of FIG. 11C identified by palette-wise number 1, whereafter thread ID "5523" is entered through numerical keys 74. Thus, the second palette table can be edited with RGB values, in other words, color information in the above described manner. The edited contents of the second palette table can be saved to EEPROM 25, which is one example of a third storage device, by operating save key 73.

The user is further allowed to add or delete color to and from each of the "Vivid", "Soft", and "Gradation" categories. More specifically, the user may add a new color into the "Vivid" category by placing a focus on a certain color of second color palette 56*a* through navigation key 71. Then, by operating "Vivid" extraction key 75 after specifying the color, the specified color can be made to be extracted as a member of the "Vivid" category even if saturation value S of the specified color is less than threshold $S_V$. Similarly, the user may add a new color into the "Soft" category, by placing a focus on a certain color of second color palette 56*a* through navigation key 71 and touching "Soft" extraction key 76 to make the specified color to be extracted as a member of the "Soft" category even if saturation value S of the specified color does not fall within the range of threshold $S_{S1}$ to $S_{S2}$. This is one example of an extraction setting.

In contrast, the user may not want to extract a certain color within the "Vivid" or "Soft" category. In such case, the user may place a focus on a certain color of second color palette 56*a* through navigation key 71. Then, by operating clear key 77 after specifying the color, the specified color can be excluded from extracted as a member of the "Vivid" for the "Soft" category even if saturation value S of the specified color is greater than threshold $S_V$ or within the range of threshold $S_{S1}$ to $S_{S2}$. This is one example of a non-extraction setting.

Exclusion of a color from an extraction-targeted category may be implemented through a "non-extraction key" not shown provided on palette setting screen 101C for both "Vivid" and/or "Soft" categories. When color has been added to or excluded from extraction target, an extraction target flag may be turned ON of OFF at step A1 of a later described flowchart to determine the presence/absence of an addition/exclusion of a certain color. A color may be added to or excluded from "Gradation" category through similar operations performed on palette setting screen 101C for the "Vivid" and "Soft" categories.

Though not described or shown in detail, first color palette 53 may be edited to add or extract a color to and from an extraction target as was the case in second color palette 56*a*. As set forth above, extraction setting and non-extraction setting are processes that add or exclude a color desired by the user from a given category through first color pallete 53 or second color palette 56*a* and is an example of color information editing.

With reference to FIGS. 12 to 16, the operation of an embroidery data processing program will be described mainly focusing on the coloring of the thread color data. FIGS. 12 to 16 are flowcharts indicating the flow of processes executed by controller 21 in accordance with the embroidery data processing program.

The user reads the embroidery data from ROM 23 through operation of touch panel 9*a* and displays a pattern selection screen not shown on LCD 9. When the desired embroidery pattern is selected by operating the pattern selection screen displaying multiple embroidery patterns, menu screen 100 illustrated in FIG. 5 is invoked that shows the selected embroidery pattern.

Figure 6:
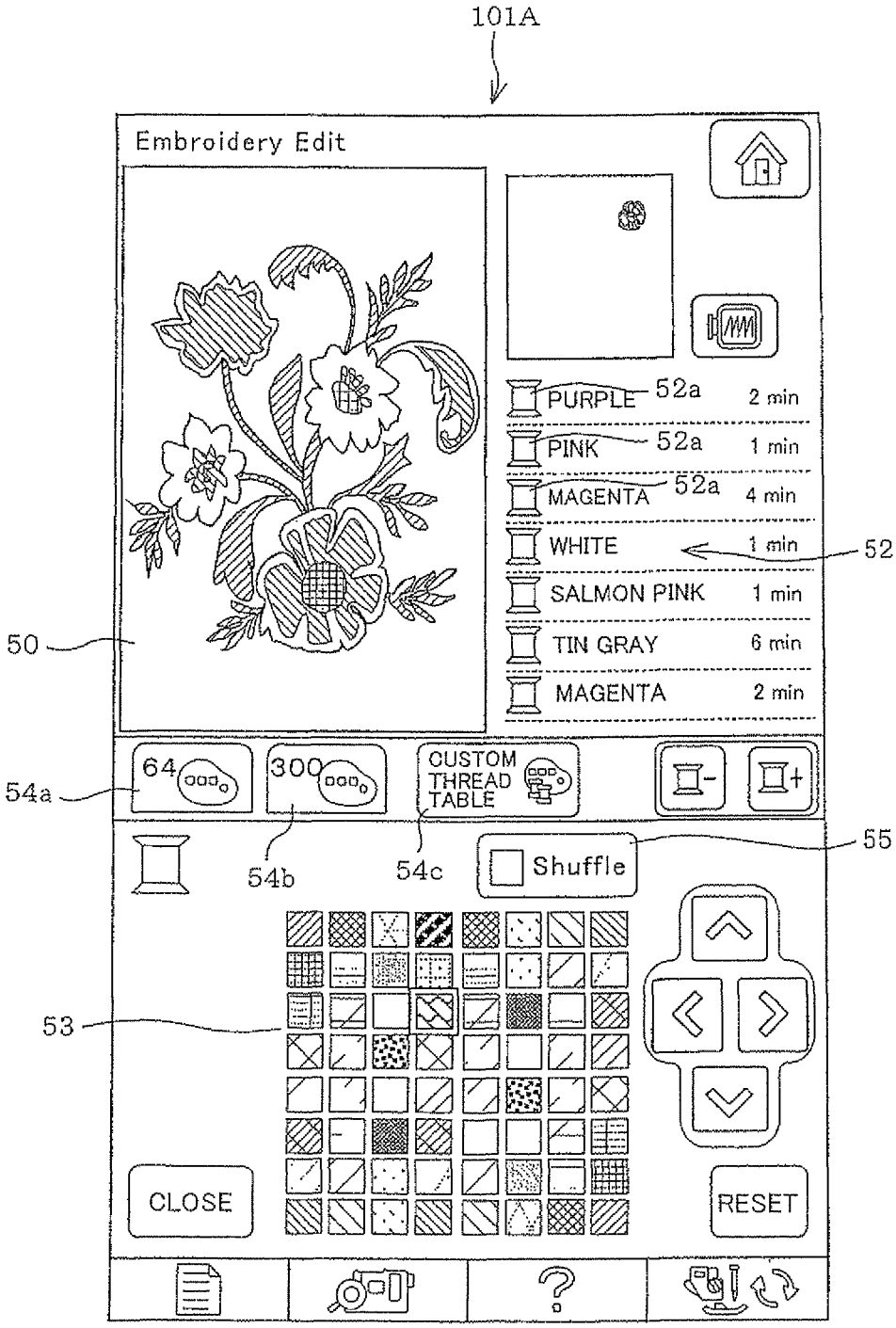
FIG. 6 is an exemplary image of a first color edit screen.
Figure 12:
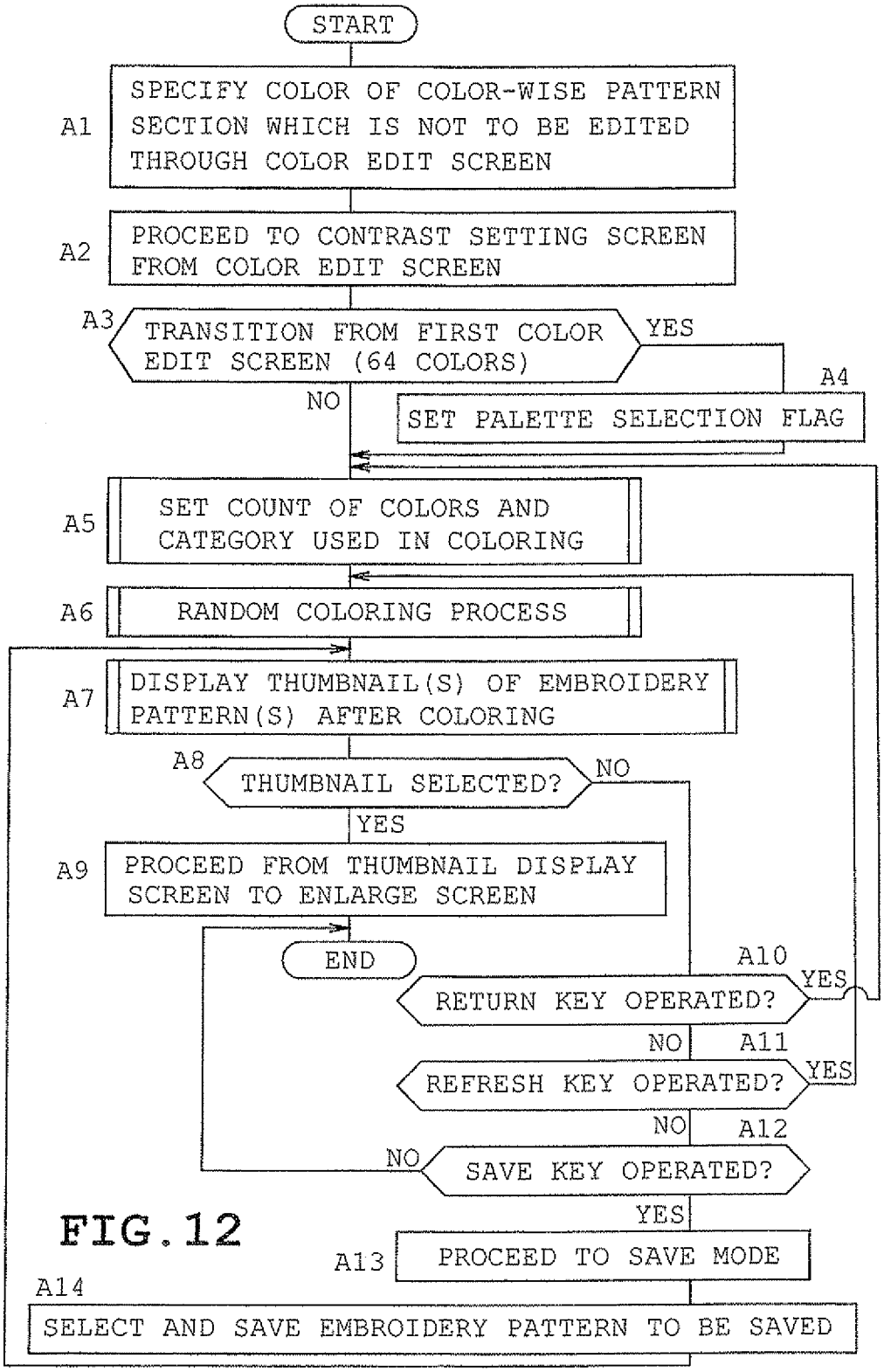
FIG. 12 is a flowchart for specifying thread color data during an embroidery data generation process.

Touching thread color edit key 51*a* in menu screen 100 invokes first color edit screen 101A illustrated in FIG. 6 and various processes for coloring of the embroidery pattern is executed. On viewing the embroidery pattern on preview image area 50 of first color edit screen 101A, in case the user decides not to change the color of the a given specific color-wise pattern section, the user is to touch thread spool icon 52*a* representing such color shown within thread color data selection area 52 (FIG. 12, step A1). Alternatively, if the user wishes to change the color of a given specific color-wise pattern section, the user may select the desired color from first color palette 53. The colors thus specified to the color-wise pattern sections are stored in extraction data storage area 249 within RAM 24. The maximum number of colors that can be specified in this case is equal to the total number of color-wise pattern sections within the selected embroidery pattern, which is represented as "n" in the example embroidery data indicated in FIG. 4. In case, every color-wise pattern section has been specified with a color at step A1, the process is terminated though not shown.

The user may also randomly assign a color to a given color-wise pattern section through color palettes, namely first color palette 53 and second color palette 56*a*. Depression of palette selection key 54*b* in first color edit screen 101A causes a screen transition from first thread edit screen 101A to second color edit screen 101B. The inter-transition between the screens allows the switching between first color palette 53 and second color palette 56*a* which are used primarily in random coloring. At step A1, various customizations can be made, typical example of which is a later described extraction setting and extraction unsetting of a given color in a given category executed through palette selection key 54*c* provided both in first thread edit screen 101A and second color edit screen 101B.

When shuffle key 55 is touched in either first color edit screen 101A or second color edit screen 101B, tone setting screen 102 is invoked (step A2). In case tone setting screen 102 was invoked from first color edit screen 101A (step A3: YES), palette flag is set (step A4).

Figure 13B:
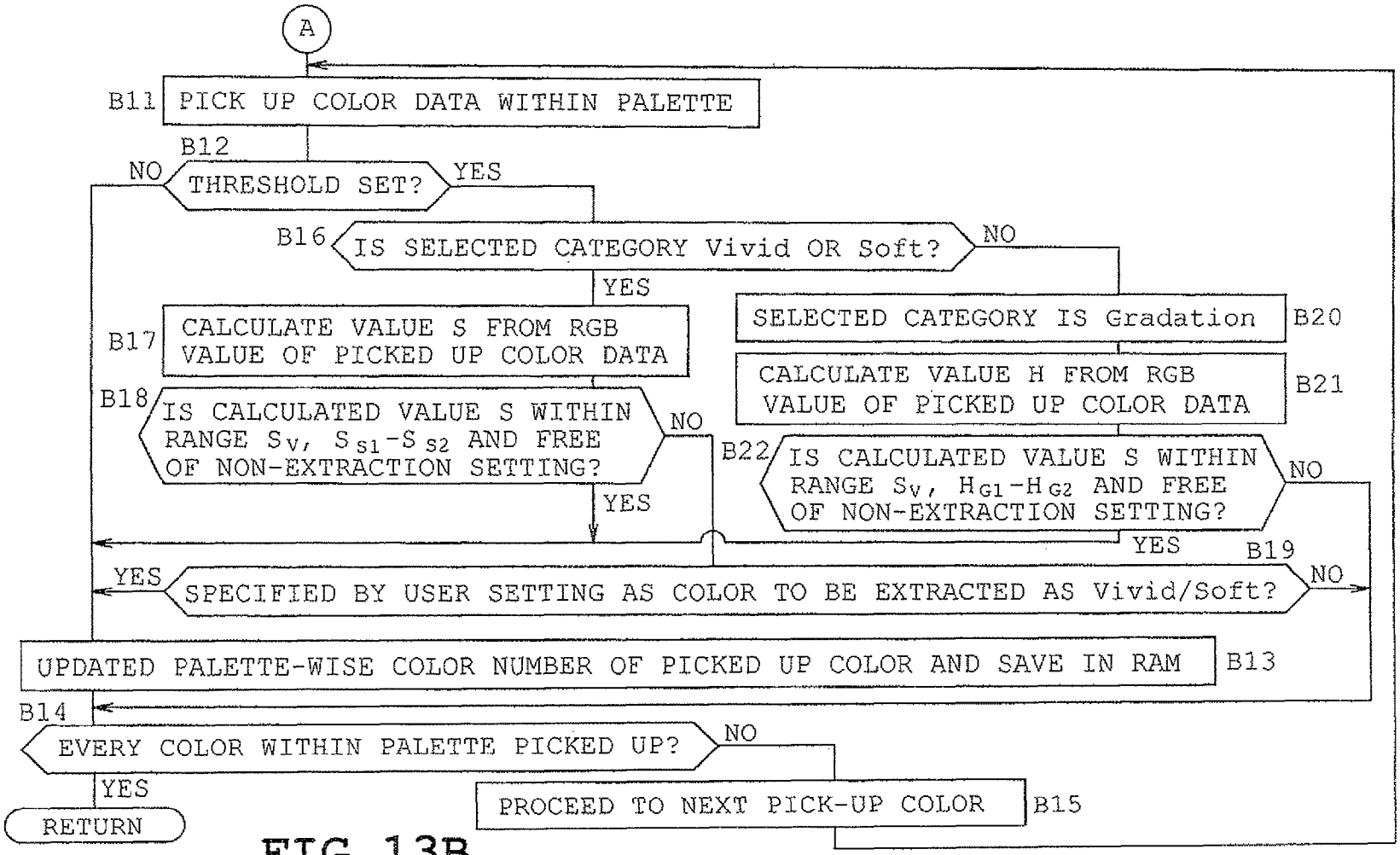

Then in tone setting screen 102, various conditions are set for the execution of random coloring (step A5) as exemplified in FIGS. 13 and 14. For example, plus key and minus key of color count specifier 57 are operated to specify the total count of colors to be used in the coloring of the selected embroidery pattern. Operation of "Random" key 58*a* flags the execution of an ordinary random coloring. The user may alternatively operate either of "Vivid" key 58*b*, "Soft" key 58*c*, and "Gradation" key 58*d* of category specifier 58 and specify the category of the colors to be extracted.

In response to the operation of either of the category keys, it is determined that the coloring to be executed is not an ordinary random coloring (step B2: NO) and if it is further determined that the "Vivid" category has been specified (step B3: YES), threshold $S_V$ is specified for the color information (step B4). In case, a No judgment is made in both steps B2 and B3, and a YES judgment is made at step B5, meaning that the "Soft" category has been specified, lower limit threshold $S_{S1}$ as well as upper limit threshold $S_{s2}$ are specified for the color information.

In case a NO decision is made in steps B2, B3, and B5, it is assumed that the "Gradation" category has been selected as step B7. Then, controller 21 refers to the palette flag and if it is found that first color palette 53 is set, a random number ranging in the number of colors within the palette is produced, which is 1 to 64 in this case. Thereafter, palette-wise color number 1-64 of the first palette table is searched to find the number that matches with the random number produced and the RGB value of the matching palette-wise color number is stored in RAM 24 (step B8). Controller 21 further calculates the HSV value based on the extracted RGB value (step B9) and specifies a range spanning from threshold $H_{G1}$ to $H_{G2}$ that centers on the calculated color phase value H (step B10).

Next, in case first color palette 53 is specified as the source of coloring, the RGB value of the palette-wise color number 1 is read from the first palette table (step B11). Then, at step B12, judgment is made as to whether or not any one of the threshold values $S_V$, $S_{S1}$ to $S_{S2}$, and $H_{G1}$ to $H_{G2}$ has been specified (step B12). If none of the threshold values is specified (step B12: NO), the RGB value of palette-wise color number 1 is stored in thread information storage area 246 (step B13). If not all the colors within the palette have been parsed (step B14: NO), the subsequent color within first color palette 53, in this case, palette-wise color number 2 is read (step B15) and judged as to whether or not a threshold value has been specified (step B12). In case a threshold value has not been specified (step B12: NO), the RGB value of palette-wise color number 2 is stored as it is in thread information storage area 246 (step B13). To summarize, steps B11 to B15 are repeated for 64 colors within first color palette 53 if no category has been specified and the first palette table is maintained intact in color information storage area 246 and the control is returned to later described step A6 of FIG. 12 (step B14: YES).

Controller 21, when judging that a threshold value has been specified (step B12: YES) for palette-wise color number 1 and the specified category is either "Vivid" or "Soft" (step B16: YES), calculates saturation value S based on the RGB value of palette-wise color number 1 (step B17). Then a judgment is made as to whether the calculated saturation value S of palette-wise color number 1 is greater than threshold values $S_V$, or within the range of $S_{S1}$ to $S_{s2}$. In case saturation value S of palette-wise color number 1 is greater than threshold values $S_V$, or within the range of $S_{S1}$ to $S_{s2}$, and non-extraction setting has not been specified (step 1318: YES), palette-wise color number 1 is stored in color information storage area 246 with the categorization of "Vivid" or "Soft" (step B13).

In contrast, even in the case a NO judgment is made at step B18, if the color associated with palette-wise color number 1 is subjected to extraction setting (step B19: YES), the color is stored in color information storage area 246 with the categorization of "Vivid" or "Soft". If not all the colors within the palette have been parsed (step B14: NO), the subsequent color within first color palette 53, in this case, palette-wise color number 2 is read (step B15) and if a judgment is made that the specified category is either "Vivid" or "Soft" (step B16: YES), calculates saturation value S based on the RGB value of palette-wise color number 2 (step B17) as was the case for palette-wise color number 1. Then a judgment is made as to whether the calculated saturation value S of palette-wise color number 1 is greater than threshold values $S_V$, or within the range of $S_{S1}$ to $S_{S2}$ and whether extraction setting or non-extraction setting has been specified (step B18 and B19). To summarize, steps B11, B12, B17, B18, B13 or B19, B14, and B15 are repeated for 64 colors within first color palette 53 if "Vivid" or "Soft" category has been specified. Thus, the first palette table is updated with the "Vivid" or "Soft" categorization and with the color specified by the user if such specification has been made and stored in color information storage area 246.

On the other hand, in case the threshold value was been specified (step B12: YES) and neither category "Vivid" nor "Soft" was specified (step 1316: NO), controller 21 makes a judgment that specified category is "Gradation" (step B20). Then, color phase value H of palette-wise color number 1 is calculated based on the RGB value (step B21) and a judgment is made as to whether or not color phase value H of the color associated with palette-wise color number 1 is within the range spanning from threshold $H_{G1}$ to $H_{G2}$ (step B22). In case color phase value H of the color associated with palette-wise color number I is within the range spanning from threshold $H_{G1}$ to $H_{G2}$ (step B22: YES), palette-wise color number 1 is stored in color information storage area 246 (step B13) with the categorization of "Gradation".

In contrast, in case a judgment is made that color phase value H of the color associated with palette-wise color number 1 is outside the range spanning from threshold $H_{G1}$ to $H_{G2}$ (step B22: NO), palette-wise color number 1 is not stored in color information storage area 246 and the control proceeds to step B14. If not all the colors within the palette have been parsed (step B14: NO), the subsequent color within first color palette 53, in this case, palette-wise color number 2 is read (step B15) and as was the case for palette-wise color number 1, in case controller 21 makes a judgment that specified category is "Gradation" (step B20), color phase value H of palette-wise color number 2 is calculated based on the RGB value (step B21). Then, a judgment is made as to whether or not color phase value H of the color associated with palette-wise color number 2 is within the range spanning from threshold $H_{G1}$ to $H_{G2}$ to judge whether or not to store the color in color information storage area 246 (step B22). To summarize, if the "Gradation" category has been specified, steps B11, B12, B16, B20, B21, B22, B13, B14, and B15 are repeated for 64 colors within first color palette 53. Thus, the first palette table is updated with the "Gradation" categorization and with the color specified by the user if such specification has been made and stored in color information storage area 246.

When the parsing of all 64 colors within first color palette 53 has been completed (step B14: YES), the process returns to step A6 indicated in FIG. 12. It is to be noted that in steps B1 to B22, in case second color palette 56*a* has been selected as the coloring palette, series of processes similar to those for first color palette 53 are executed. The following description are based upon the assumption that the total number colors in first color palette 53 or second color palette 56 is p after registration of colors based on category has been completed, i.e. after all the colors have been parsed (step B14: YES) for first color palette 53 or second color palette 56*a*.

Figure 14A:
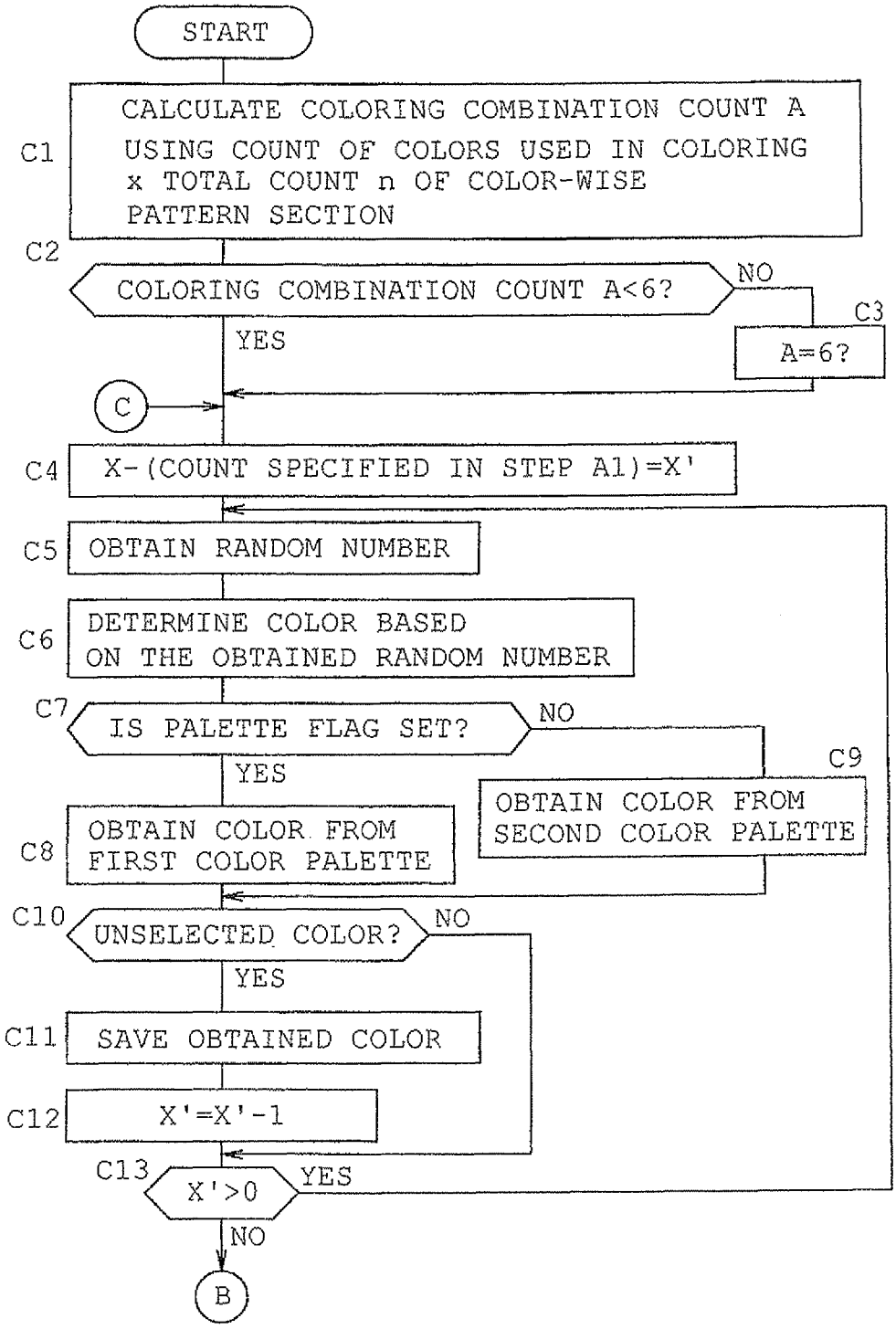
FIGS. 14A and 14B taken together indicate a flowchart for color extraction and color allocation processes.
Figure 14B:
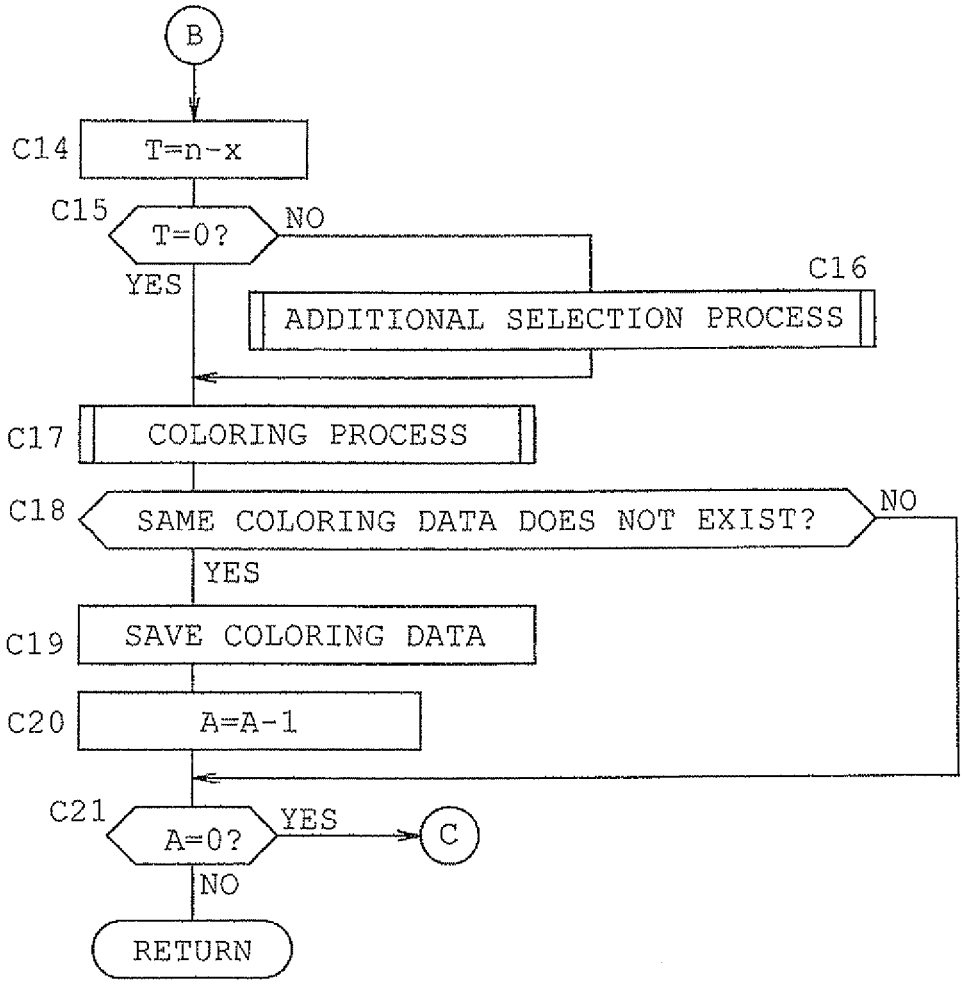

At step A6, random coloring process indicated in FIGS. 14A and 14B is carried out for the selected embroidery pattern based on the above described settings. In the random coloring process, extraction routine (step C1 to C16) and allocation routine (step C17) is executed. The extraction routine randomly extracts, from the first or the second palette table of color information storage area 246, the colors to be used as the thread color data. The allocation routine allocates the color extracted by the extraction routine to each of the thread color data of the color-wise pattern section.

First, based on the count of colors to be assigned which is identified by a parameter referred to as "coloring count x", and total count of color-wise pattern sections within the selected embroidery pattern referred to by a parameter referred to as "total count n", the number of possible combinations of colors for the selected embroidery pattern referred to as "combination count A" is obtained (step C1).

In the present embodiment, because six variations of the selected embroidery pattern with unique coloring need to be displayed on thumbnail screen 103, "combination count A" is obtained mathematically through combination so that none of the combinations are repeated. For instance, when "coloring count x" is 1 and "total count n" of color-wise pattern sections is 1, "combination count A" is given by ${}_pC_1$. As can be understood from above, "combination count A" of the coloring of the selected embroidery pattern is proportionally related to "total count p" of color palettes 53 or 56*a* and when "total count p" is 2 or more and "coloring count x" is 3 or more, "combination count A" becomes 6 or more. In such case, a NO decision is made at step C2 and 6 sets of embroidery data are generated (step C3). Further, in case "combination count A" calculated in step C1 is less than 6 (step C2: YES), that much count of embroidery data is generated.

Then, the number of color-wise pattern sections specified by the user in step A1 that the user does not wish the color to be changed, if any, is subtracted from "coloring count x" to calculate the count of colors X' to be extracted in a single embroidery pattern (step C4). Then, controller 21 produces a random number from the range of colors of the first or the second palette table stored in color information storage area 246 amounting to "total count p". For instance, in case first color palette 53 is specified as the palette from which the colors are assigned and no category has been specified, the random number is produced from the numbers ranging from 1 to 64 (step C5). Then, controller 21 randomly extracts colors based on the produced random number and the status of the palette flag (step C6 to C9). More specifically, when judging that first color palette 53 has been selected (step C7: YES) based on the status of the palette flag, the first palette table is parsed to find a palette-wise color number that matches the produced random number. Then, the RGB value that is associated with the matching palette-wise color number is extracted (step C8) and if the extracted ROB value is not the same as the RGB value associated with the color specified in step A1 (step C10: YES), the extracted RGB value is stored in extraction data storage area 249 of RAM 24 (step C11).

Whenever the extracted color is stored in extraction data storage area 249, the count of colors x' is updated to x'=x'−1 (step C12). When there are more colors to be extracted (step C13: YES), steps C5 to C10 are repeated for the second color onwards and if the extracted color is not the same as the color (s) already extracted or specified in step A1 (step C10: YES), the extracted color is stored and X' is decremented as was the case in the first extracted color. Until the count of decremented color x' is judged to be equal to or less than 0 (step C13: NO), steps C5 to 013 are repeated. Accordingly, extraction data storage area 249 stores the colors used in a single embroidery pattern which is a group of unique colors specified in step A1 and extracted in step C5 to step C13.

Next, "shortage T" which is the difference between "total count n" of the color-wise pattern section and "specified count of colors x" is calculated (step C14) and if "shortage T" occurs (step C15: NO), the control proceeds to an additional selection process (step C16).

Figure 15:
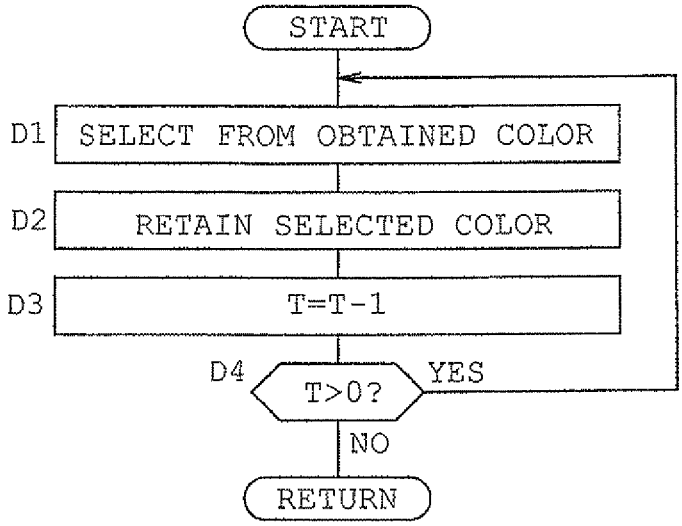
FIG. 15 is a flowchart of an additional selection process.

Referring to FIG. 15, additional selection process begins with selection of additional colors from extraction data storage area 249 to equalize count n of color-wise pattern sections and the count of colors stored in extraction data storage area (step D1) to meet the requirements in executing the coloring process. The selected color is additionally stored in extraction data storage area 249 (step D2) and shortage T is updated to T=T−1 (step D3). Steps D1 to D4 are repeated until shortage T is eliminated (step D4: NO). Accordingly, extraction data storage area 249 is configured to store a number of colors that are equal to "total count n".

When the count of colors stored in extraction data storage area 249 and "total count n" of the color-wise pattern sections are equal (step D4: NO or step D15: YES), the process flow proceeds to the coloring process (step C17).

Figure 16:
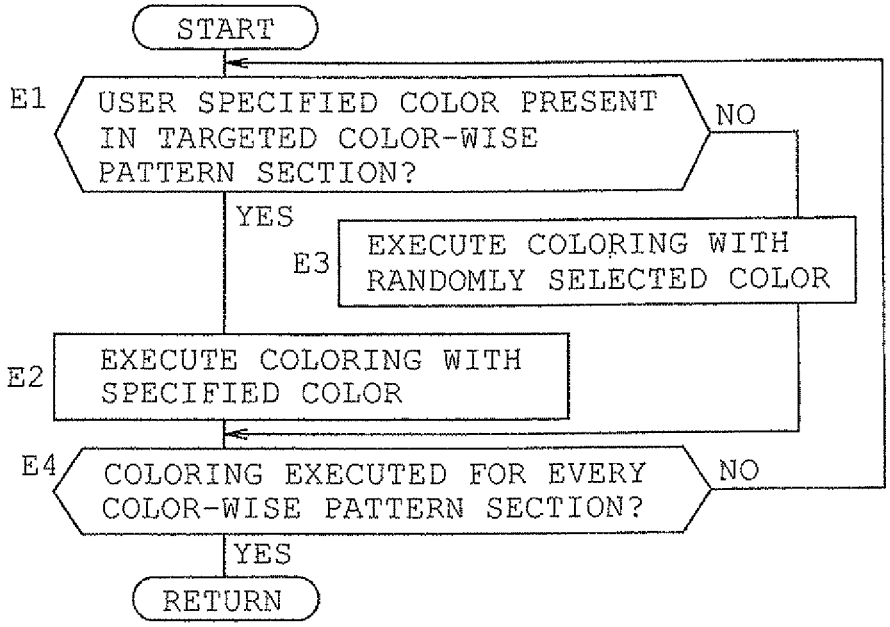
FIG. 16 is a flowchart of coloring process executed for each embroidery pattern.

As can be seen in FIG. 16, the coloring process determines the presence and absence of color specification made by the user at step A1 (step E1) for every thread color data of the color-wise pattern section. At this instance, each thread color data having been specified a color by the user is given allocation of such specified color (step E2) and if not, a color is randomly allocated to such color data (step E3). When allocating the randomly extracted colors, the color stored in extraction data storage area 249 is shuffled. This is because when the aforementioned additional selection process is executed, extraction data storage area 249 is caused to contain repeated instances of same colors. Thus, the colors within the extraction data storage area 249 are randomly rearranged. When repeating steps E1 to 54, step E3 gives randomness to the process by allowing the allocation of rearranged or shuffled colors. When coloring of every color-wise pattern sections has been completed, the process returns to step C18 of the flowchart of FIG. 14B.

After verifying that no identical coloring data exists (step C18: NO) and saving the verified coloring data (step C19: NO), the coloring of the first embroidery pattern is deemed to have been completed. Then, every thread color data pertaining to the embroidery data is stored in RAM 24 (step C19). Thereafter, the combination count A is updated to A=A−1 (step C20) and if A>0 (step C21: YES) the process returns to step C4 to repeat steps C4 to C18 for the coloring of the second coloring pattern and onwards. If the resulting coloring differs from the preceding colorings (step C18: YES), the storing of the thread color data (step C19) and decrementing of A (step C20) is carried out as done for the first coloring pattern. Until A is found to be 0 or less (step C21: NO), steps C4 to 021 are repeated to produce A number of unique coloring patterns. Thereafter, the process returns to step A7 of FIG. 12.

Steps A7 to A9 execute a display routine that displays the embroidery pattern generated at step A6 to LCD 9 with the color of the thread color data assigned to each color-wise pattern section. For example, at step A7, shrunk thumbnail images of A number of embroidery patterns, which is 9 in the present embodiment, are displayed on thumbnail screen 103. In case thumbnail image 61*a* of the embroidery pattern located at the upper right in FIG. 9 is touched (step A8: YES), enlarge screen 104 illustrated in FIG. 10 is invoked (step A9). In the enlarged screen 109, enlarged image of the embroidery pattern of the selected thumbnail image is displayed. Then, when set key 67 is operated, the screen is switched backed to menu screen 100 in which the embroidery pattern displayed in enlarged image area 65 of enlarged screen 104 is shown as the preview image (end).

In case return key 62 is operated in thumbnail screen 103 (step A10: YES), the control proceeds to step A5 and tone setting screen 102 is displayed and allows the user to re-specify various settings of the coloring process and re-execute the random coloring process. In case refresh key 64 is operated (step A11: YES), the control proceeds to step A6 and re-executes the random coloring process. This allows newly extracted colors to be allocated to the thread color data and the six embroidery patterns currently being displayed are replaced by the six new embroidery patterns.

In case save key 63 is operated in thumbnail screen, on the other hand (step A12: YES), the program runs in the save mode (step A13). In the save mode, when one or more of thumbnail images 61*a* are selected through the touch operation, the embroidery data of the selected embroidery pattern is stored in EEPROM 25 (step A14). Steps A12 to A14 thus, executes a save routine in which the embroidery data of the embroidery pattern selected by the user is saved whereafter the control returns to step A7.

Controller 21 that executes steps C1 to C16 is one example of an extractor that randomly extracts the colors used as the color data. Controller 21 that executes step C17 is one example of an allocator that allocates the extracted color.

As described above, embroidery data generating device 30 of the present embodiment randomly extracts a color to be used as thread color data from each color information by the extractor and allocates the extracted color to the thread color data by the extractor. This allows a random coloring of an embroidery pattern by randomly allocating the extracted color to the thread color data of the color-wise embroidery pattern sections. Advantageously, coloring of the embroidery pattern can be facilitated by eliminating the cumbersome tasks of checking the available thread color data and specifying the thread color data. Further, because the embroidery patterns are randomly colored, the user may encounter unexpectedly satisfying coloring patterns that the user would not have thought of when the colors were selected based on the user's preferences or on predetermined or conventional coloring.

The extractor randomly extracts "multiple" colors to be used as the thread color information from the color information. Thus, after randomly extracting such "multiple" colors, the multiple colors can be randomly allocated as indicated in step E3. In other words, because the colors that were randomly extracted are randomly allocated, the resulting coloring can be increasingly randomized.

Controller 21 that executes step B1 and touch panel 9*a* are examples of a color count specifier that specifies the count of colors to be extracted. The color count specifier allows the count of thread colors used in a given embroidery pattern to be specified based on user preference and sensibility of color.

Controller 21 that executes steps B1 to B19 is one example of a categorizer that classifies the color information into different categories. Controller 21 and touch panel 9*a* are examples of a category selector that selects either one of the categories. The category selector allows a category desired by the user to be selected in selecting the thread color to be applied to the embroidery pattern. Thus, while the embroidery pattern is randomly colored, an embroidery data carrying a category of colors reflecting the preference and sensitivity of the user can be generated with ease.

The color information being classified into categories are editable by the user. Thus, the user is allowed to add a desired color or replace an existing color with a color selected from the user's collection of thread spools, and generate embroidery data using the desired colors.

LCD 9 displays each color-wise pattern section of the embroidery pattern in the color allocated to the thread color data. Thus, the colors of the color-wise pattern sections of the generated embroidery data can be readily informed visually to the user.

LCD 9 displays the variations of the embroidery pattern on thumbnail screen 103 with each variation having unique combination of randomly assigned colors and the user is allowed to pick the desired embroidery data from the choices of variations and save it to EEPROM 25. Thus, usability can be improved while facilitating generation embroidery data being colored according to the user's preference and sensibility of color.

Color extraction and allocation (step AG) that is re-executed by the operation of refresh key 64 at step A11 is referred to a recoloring routine and controller 21 that executes steps A11 and A6 and touch panel 9*a* are examples of a recoloring instruction unit. Further, in case embroidery data with a new coloring is generated by the recoloring routine, a re-display routine (step A7) is executed that displays the embroidery pattern on LCD 9 in the newly allocated color. According to such configuration, whenever the recoloring instruction unit is executed to re-extract and re-allocate colors for use with the thread color data, the newly color embroidery data can be confirmed by the user through the image of the embroidery pattern displayed on LCD 9. Thus, the embroidery pattern displayed on thumbnail screen 103 can be reproduced repeatedly based on a newly colored embroidery data generated by the recoloring instruction unit to the user's satisfaction.

Controller 21 that executes step A1 and touch panel 9*a* are examples of a specifier that specifies the color of the thread color data of the color-wise pattern section. The specifier allows a given color-wise pattern section to be specified by a color that is desired by the user while allowing of random coloring of other color-wise pattern sections. Thus, embroidery data generation can be simplified while incorporating colors desired by the user.

Multiple colors that are used as the thread color data are randomly extracted from the choice of colors pre-selected by the user and stored in the EEPROM 25. Thus, by presetting the user's desired colors or colors available in the user's thread spool collection into EEPROM 25 embroidery data can be generated as desired by the user.

The present invention is not limited to the foregoing embodiment but may be modified or expanded as follows.

Embroidery data generating device 30 need not be provided within sewing machine M but may be incorporated in a readily available personal computer connected to components such as a mouse, a keyboard, a memory card connector, and a display.

The first to third storage device are not limited to RAM 24 or EEPROM 25 but may be configured as a storage incorporated in the sewing machine or the embroidery data generating device, or a removable storage detachably attached to the sewing machine or the embroidery data generating device. In case the sewing machine and the embroidery data generating device are configured separately unlike the foregoing embodiment, the sewing machine and the embroidery data generating device may exchange data by wire or wireless communication.

The computer readable medium that stores the embroidery data processing program is not limited to ROM 23 of controller 21 but may be configured by CD-ROM, flexible disk, DVD, memory card 11, or the like. In such case, the computer readable medium is read and executed through the computer of a controller provided in the embroidery data generating device to provide operation and effects similar to those of the foregoing embodiment.

The foregoing description and drawings are merely illustrative of the principles of the present invention and are not to be construed in a limited sense. Various changes and modifications will become apparent to those of ordinary skill in the art. All such changes and modifications are seen to fall within the scope of the invention as defined by the appended claims.

That is claimed is:

1. An embroidery data generating device which generates embroidery data that is used for sewing an embroidery pattern including multiple color-wise pattern sections with a sewing machine and that includes thread color data specifying a color of each of the color-wise pattern sections, the embroidery data generating device comprising:

a first storage device that stores multiple entries of preset color information;

an extractor that randomly extracts color data used as the thread color data from each entry of the color information stored in the first storage device;

a categorizer that classifies the color information into multiple categories; and a category selector that selects one of the multiple categories, wherein the extractor randomly extracts multiple entries of color data used as the thread color data from multiple entries of color data belonging to the category selected by the category selector; and an allocator that randomly allocates the multiple entries of color data extracted by the extractor to each of the thread color data associated with each of the multiple color-wise pattern sections.

2. The embroidery data generating device according to claim 1, wherein the extractor randomly extracts multiple entries of color data used as the thread color data from the multiple entries of color information and the allocator randomly allocates the multiple entries of color data extracted by the extractor to the thread color data of each of the color-wise pattern sections.

3. The embroidery data generating device according to claim 1, further comprising a color count specifier that specifies a count of color data to be extracted by the extractor, wherein the extractor randomly extracts the specified count of unique color data and the allocator randomly allocates the extracted color data to each of the color-wise pattern sections.

4. The embroidery data generating device according to claim 1, wherein the color information classified into the multiple categories is editable by a user.

5. The embroidery data generating device according to claim 1, further comprising a display unit that displays an image of the embroidery pattern in a color of the thread color data allocated to each of the color-wise pattern sections.

6. The embroidery data generating device according to claim 5, further comprising a second storage device that stores the embroidery data generated by the embroidery data generating device, wherein the display unit displays a screen showing multiple images of embroidery patterns each comprising unique combinations of colors, and is configured to store in the second storage device the embroidery data associated with the image of the embroidery pattern selected by a user from the multiple images of embroidery patterns shown on the display unit.

7. The embroidery data generating device according to claim 5, further comprising a recoloring instruction unit that, after the image of the embroidery pattern has been displayed on a screen shown on the display unit, re-executes the extraction and the allocation in response to user instructions, wherein the display unit, when coloring of the embroidery data is updated by the recoloring instruction unit, displays the image of the embroidery pattern in the updated coloring.

8. The embroidery data generating device according to claim 1, further comprising a specifier that specifies a color desired by a user to the thread color data of the color-wise pattern sections, wherein the allocator randomly allocates the color data extracted by the extractor to the thread color data of one or more of the color-wise pattern sections not specified by the specifier.

9. The embroidery data generating device according to claim 1, further comprising a third storage device that stores multiple entries of color data being independent of and being pre-selected by a user from the color information stored in the first storage device, wherein the extractor randomly extracts multiple entries of color data to be used as the thread color data from the third storage device.

10. A non-transitory computer readable medium for use with an embroidery data generating device provided with a first storage device storing multiple entries of preset color information, the computer readable medium storing an embroidery data processing program that is used to generate embroidery data used for sewing an embroidery pattern including multiple color-wise pattern sections with a sewing machine, the embroidery data including thread color data specifying a color of each of the color-wise pattern sections, the embroidery data processing program, comprising:

instructions for randomly extracting color data used as the thread color data from each entry of the color information stored in the first storage device; and instructions for allocating the extracted color data to each of the thread color data associated with each of the color-wise pattern sections:

wherein the embroidery data generating device includes a categorizer that classifies the color information into multiple categories and a category selector that selects one of the multiple categories, and the randomly extracting extracts multiple entries of color data used as the thread color data from multiple entries of color data belonging to the category selected by the category selector.

11. The medium according to claim 10, wherein the randomly extracting extracts multiple entries of color data used as the thread color data from the multiple entries of color information and the randomly allocating allocates the multiple entries of color data extracted by the extractor to the thread color data of each of the color-wise pattern sections.

12. The medium according to claim 10, wherein the embroidery data generating device includes a color count specifier that specifies a count of color data to be extracted by the extracting, wherein the randomly extracting extracts the specified count of unique color data and the randomly allocating allocates the extracted color data to each of the color-wise pattern sections.

13. The medium according to claim 10, wherein the embroidery data processing program further comprises instructions for allowing a user to edit the color information classified into the multiple categories.

14. The medium according to claim 10, wherein the embroidery data generating device includes a display unit and the embroidery data processing program further comprises instructions for displaying an image of the embroidery pattern in a color of the thread color data allocated to each of the color-wise pattern sections.

15. The medium according to claim 14, wherein the embroidery data generating device includes a second storage device and the displaying displays a screen on the display unit that shows multiple embroidery patterns each comprising unique combinations of colors, the embroidery data processing program further comprising instructions for storing in the second storage device the embroidery data associated with the embroidery pattern selected by a user from the multiple embroidery patterns shown on the display unit.

16. The medium according to claim 14, wherein the embroidery data processing program further comprises instructions for recoloring that, after the image of the embroidery pattern has been displayed on a screen shown on the display unit, re-executes the extracting and the allocating in response to user instructions, wherein the display unit, when coloring of the embroidery data is updated by the recoloring, displays the image of the embroidery pattern in the updated coloring.

17. The medium according to claim 10, wherein the embroidery data generating device includes a specifier that specifies a color desired by a user to the thread color data of the color-wise pattern sections, wherein the randomly allocating allocates a color extracted by the randomly extracting to the thread color data of one or more of the color-wise pattern sections not specified by the specifier.

18. The medium according to claim 10, wherein the embroidery data generating device further includes a third storage device that stores multiple entries of color data being independent of and being pre-selected by a user from the color information stored in the first storage device, wherein the randomly extracting extracts multiple entries of color data to be used as the thread color data from the third storage device.

19. A sewing machine, that sews an embroidery pattern including multiple color-wise pattern sections and that is provided with an embroidery data generating device that generates embroidery data including thread color data specifying a color of each of the color-wise pattern sections, the sewing machine comprising:

a first storage device that stores multiple entries of preset color information;

an extractor that randomly extracts color data used as the thread color data from each entry of the color information stored in the first storage device;

a categorizer that classifies the color information into multiple categories;

a category selector that selects one of the multiple categories, wherein the extractor randomly extracts multiple entries of color data used as the thread color data from multiple entries of color data belonging to the category selected by the category selector; and an allocator that randomly allocates the multiple entries of color data extracted by the extractor to each of the color-wise pattern sections.

20. The embroidery data generating device according to claim 1, wherein the category selected is one of: ordinary random, vivid, soft and gradation.

* * * * *